US008215744B2

(12) United States Patent
Yamanobe

(10) Patent No.: US 8,215,744 B2
(45) Date of Patent: Jul. 10, 2012

(54) IMAGE FORMING METHOD AND IMAGE FORMING APPARATUS

(75) Inventor: Jun Yamanobe, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 703 days.

(21) Appl. No.: 12/332,785

(22) Filed: Dec. 11, 2008

(65) Prior Publication Data

US 2009/0153613 A1 Jun. 18, 2009

(30) Foreign Application Priority Data

Dec. 14, 2007 (JP) ..... 2007-323754
Feb. 25, 2008 (JP) ..... 2008-043114

(51) Int. Cl.
*B41J 2/015* (2006.01)

(52) U.S. Cl. ..... 347/21

(58) Field of Classification Search ..... None
See application file for complete search history.

(56) References Cited

U.S. PATENT DOCUMENTS 6,012,809 A 1/2000 Ikeda et al.
6,283,589 B1 * 9/2001 Gelbart ..... 347/101
6,341,854 B1 1/2002 Takemoto
7,820,349 B2 * 10/2010 Takagi et al. ..... 430/108.1
2007/0229577 A1 * 10/2007 Morimoto ..... 347/21

FOREIGN PATENT DOCUMENTS

JP 8-132729 A 5/1996
JP 9-254376 A 9/1997
JP 2000-37942 A 2/2000
JP 2004-136458 A 5/2004
JP 2007-268845 A 10/2007
JP 2007-276400 A 10/2007

* cited by examiner

*Primary Examiner* — Matthew Luu
*Assistant Examiner* — Erica Lin
(74) *Attorney, Agent, or Firm* — Birch, Stewart, Kolasch & Birch, LLP

(57) ABSTRACT

An inkjet recording apparatus records an image onto a recording medium by using an ink containing a coloring material, and the inkjet recording apparatus has: a first treatment agent deposition device which deposits a first treatment agent having a function of suppressing permeation of liquid into the recording medium, onto the recording medium; a second treatment agent deposition device which deposits a second treatment agent having at least one of a function of aggregating the coloring material contained in the ink and a function of increasing viscosity of the ink, onto the recording medium; an image processing device which converts input image data into dot data; and an ink droplet ejection head which ejects droplets of the ink onto the recording medium in accordance with the dot data.

19 Claims, 18 Drawing Sheets

FIG.16

| NO. | PAPER | PERMEATION SUPPRESSION LAYER | PAPER TEMPERATURE T1 DURING DEPOSITION OF PERMEATION SUPPRESSION LAYER | TREATMENT LIQUID | INK | TREATMENT LIQUID DRYING TEMPERATURE T3 | INK DRYING TEMPER-ATURE | FIXING TEMPER-ATURE T2 | CURL | FIXING PROPERTY | BLEEDING | FLOATING OF COLORING MATERIAL |
|---|---|---|---|---|---|---|---|---|---|---|---|---|
| 1 | URITE | NO LAYER | - | NO TREATMENT LIQUID | INK A | NO DRYING | 70°C | 80°C | POOR | POOR | POOR | POOR |
| 2 | URITE | NO LAYER | - | TREATMENT LIQUID PRESENT | | NO DRYING | 70°C | 80°C | POOR | POOR | GOOD | POOR |
| 3 | URITE | PERMEATION SUPPRESSION AGENT A ($T_g$=38°C $T_{rl}$=28°C) | 20°C (NO HEATING) | TREATMENT LIQUID PRESENT | | NO DRYING | 70°C | 80°C | POOR | NOT POOR | EXELLENT | POOR |
| 4 | URITE | | 40°C | TREATMENT LIQUID PRESENT | | NO DRYING | 70°C | 80°C | EXELLENT | NOT POOR | EXELLENT | POOR |
| 5 | URITE | | 20°C (NO HEATING) | TREATMENT LIQUID PRESENT | | 50°C | 70°C | 80°C | POOR | NOT POOR | EXELLENT | POOR |
| 6 | URITE | | 40°C | TREATMENT LIQUID PRESENT | | 50°C | 70°C | 80°C | GOOD | NOT POOR | EXELLENT | EXELLENT |
| 7 | URITE | | 40°C | TREATMENT LIQUID PRESENT | | 35°C | 70°C | 80°C | EXELLENT | NOT POOR | EXELLENT | EXELLENT |
| 8 | URITE | | 20°C (NO HEATING) | TREATMENT LIQUID PRESENT | INK B | 50°C | 70°C | 80°C | POOR | GOOD | EXELLENT | EXELLENT |
| 9 | URITE | | 40°C | TREATMENT LIQUID PRESENT | | 50°C | 70°C | 80°C | GOOD | GOOD | EXELLENT | EXELLENT |
| 10 | URITE | | 40°C | TREATMENT LIQUID PRESENT | | 35°C | 70°C | 80°C | EXELLENT | GOOD | EXELLENT | EXELLENT |
| 11 | URITE | | 20°C (NO HEATING) | TREATMENT LIQUID PRESENT | INK C | 50°C | 70°C | 80°C | POOR | EXELLENT | EXELLENT | EXELLENT |
| 12 | URITE | | 40°C | TREATMENT LIQUID PRESENT | | 50°C | 70°C | 80°C | GOOD | EXELLENT | EXELLENT | EXELLENT |
| 13 | URITE | | 40°C | TREATMENT LIQUID PRESENT | | 35°C | 70°C | 80°C | EXELLENT | EXELLENT | EXELLENT | EXELLENT |
| 14 | URITE | | 40°C | TREATMENT LIQUID PRESENT | | 35°C | 70°C | 35°C | EXELLENT | POOR | EXELLENT | EXELLENT |
| 15 | URITE | PERMEATION SUPPRESSION AGENT B ($T_{g1}$=55°C $T_{r1}$=43°C) | 20°C (NO HEATING) | TREATMENT LIQUID PRESENT | INK B | 35°C | 70°C | 80°C | POOR | GOOD | EXELLENT | EXELLENT |
| 16 | URITE | | 35°C | TREATMENT LIQUID PRESENT | | 35°C | 70°C | 80°C | NOT POOR | GOOD | EXELLENT | EXELLENT |
| 17 | URITE | | 60°C | TREATMENT LIQUID PRESENT | | 35°C | 70°C | 80°C | EXELLENT | GOOD | EXELLENT | EXELLENT |
| 18 | URITE | | 60°C | TREATMENT LIQUID PRESENT | | 35°C | 70°C | 45°C | EXELLENT | POOR | EXELLENT | EXELLENT |
| 19 | URITE | | 60°C | TREATMENT LIQUID PRESENT | | 60°C | 70°C | 80°C | GOOD | GOOD | EXELLENT | EXELLENT |
| 20 | URITE | | 20°C (NO HEATING) | TREATMENT LIQUID PRESENT | INK C | 35°C | 70°C | 80°C | POOR | EXELLENT | EXELLENT | EXELLENT |
| 21 | URITE | | 35°C | TREATMENT LIQUID PRESENT | | 35°C | 70°C | 80°C | NOT POOR | EXELLENT | EXELLENT | EXELLENT |
| 22 | URITE | | 60°C | TREATMENT LIQUID PRESENT | | 35°C | 70°C | 80°C | EXELLENT | EXELLENT | EXELLENT | EXELLENT |
| 23 | URITE | | 60°C | TREATMENT LIQUID PRESENT | | 35°C | 70°C | 45°C | EXELLENT | POOR | EXELLENT | EXELLENT |

IMAGE FORMING METHOD AND IMAGE FORMING APPARATUS

BACKGROUND OF THE INVENTION

1. Field of the Invention

The present invention relates to an image forming method and an image forming apparatus, and more particularly, to image recording technology which prevents curl, and the like, that occurs in a recording medium during image recording or after image recording.

2. Description of the Related Art

When printing using a water-based inkjet onto papers which are generally used in printing, such as art paper and coated paper, high-grade papers and other non-coated papers, there are known problems such as the occurrence of deformation of the paper, known as "curl", due to the breaking and recoupling of hydrogen bonds between the cellulose fibers of the paper. As a countermeasure for preventing "curl", there are methods such as adding a curl preventing agent, such as a sugar, to the ink, or using a strong paper suppressing mechanism in the conveyance unit and thus providing a mechanism which forcibly suppresses curl, but none of these methods suppress the curl to a sufficient degree.

Japanese Patent Application Publication No. 2004-136458 discloses a recording apparatus which deposits alcohol on paper prior to ink recording, so that the paper reaches a recording position in a state where the paper has substantially dried, and then records an image thereon. In the recording apparatus according to Japanese Patent Application Publication No. 2004-136458, due to the fact that the hydroxy groups in the alcohol solution bond with the hydroxy groups present at the bond points of the hydrogen bonds between the cellulose fibers, then even if water subsequently becomes present on the paper, the water molecules are repelled by the hydrophobic group part of the alcohol solution and are not able to reach the bonds between the fibers, and therefore in the process of drying the paper, movement of the bond points between the fibers is not liable to occur and curling of the paper is suppressed.

Japanese Patent Application Publication No. 9-254376 discloses an inkjet recording method and apparatus which deposits a treatment liquid that suppresses permeation of the ink, separately from the ink. Furthermore, U.S. Pat. No. 6,283,589 describes rendering a substrate hydrophobic before ejecting droplets of ink.

However, in the paper curl suppression method and the recording apparatus described in Japanese Patent Application Publication No. 2004-136458, it is known that since alcohol is deposited onto the paper before ejecting droplets of a water-based ink, then there are problems in that ink repellent and bleeding of the image may occur. In order to resolve these problems of repellent and bleeding of the ink, it could be considered to dry the surface of the paper after depositing the alcohol solution on the paper, but a problem has been discovered in that curl occurs again when ink droplets are subsequently ejected onto the paper. In other words, in technology disclosed in Japanese Patent Application Publication No. 2004-136458, the image properties and the suppression of curl are mutually conflicting factors and it is difficult to achieve both at the same time.

Furthermore, in the invention described in Japanese Patent Application Publication No. 9-254376, it is possible to cause the coloring material in the ink to insolubilize (aggregate) due to the action of the components (such as cationic surfactant, or the like) in the treatment liquid, and therefore permeation of the coloring material (dye) of the ink into the interior of the paper is suppressed reliably, but since the treatment liquid does not react with the solution (water component) of the ink, then it is not possible to suppress the solvent of the ink from permeating inside the paper. In other words, although Japanese Patent Application Publication No. 9-254376 claims to "suppress the permeation of ink", in fact the invention described in Japanese Patent Application Publication No. 9-254376 simply suppresses the permeation of coloring material inside the ink and does not readily suppress curling of the paper.

In the invention described in U.S. Pat. No. 6,283,589, the capillary force received by the solvent in the ink is reduced by rendering the substrate (paper) hydrophobic in advance, and therefore the permeation of ink into the substrate is suppressed. On the other hand, in the invention described in U.S. Pat. No. 6,283,589, it has been discovered that since the spreading of the ink dots is also suppressed, then problems arise in that gaps occur between ink dots which are originally intended to overlap with (make contact with) each other, and as a result there is a problem in that the optical density declines markedly, and furthermore, "banding" caused by error in the dot positions becomes more pronounced.

SUMMARY OF THE INVENTION

The present invention has been contrived in view of these circumstances, an object thereof being to provide an image forming method and an image forming apparatus whereby desirable image recording can be carried out, without the occurrence of abnormalities, such as curling of the recording medium.

In order to attain an object described above, one aspect of the present invention is directed to an inkjet recording apparatus which records an image onto a recording medium by using an ink containing a coloring material, the inkjet recording apparatus comprising: a first treatment agent deposition device which deposits a first treatment agent having a function of suppressing permeation of liquid into the recording medium, onto the recording medium; a second treatment agent deposition device which deposits a second treatment agent having at least one of a function of aggregating the coloring material contained in the ink and a function of increasing viscosity of the ink, onto the recording medium; an image processing device which converts input image data into dot data; and an ink droplet ejection head which ejects droplets of the ink onto the recording medium in accordance with the dot data.

According to this aspect of the invention, since a first treatment agent which has a function of suppressing the permeation of liquid into the recording medium is deposited on the recording medium, then the second treatment agent which has a function of aggregating the ink and the coloring material in the ink or a function of increasing the viscosity of the ink dots is restricted from permeating into the recording medium, in addition to which the permeation of the ink into the recording medium is suppressed, and therefore it is possible to prevent curl which arises due to the permeation of liquid into the recording medium. Furthermore, since the second treatment agent is held on the surface of the recording medium, then the second treatment agent and the ink react together swiftly on the surface of the recording medium, and hence spreading and bleeding of the ink are prevented. The present invention displays particularly beneficial effects in cases where an image is recorded onto a recording medium having permeable properties.

The first treatment agent has a composition which does not produce curl even if the first treatment agent permeates into the recording medium. A possible example of a composition of this kind is a solution based on a nonaqueous solvent (for example, a lipid solvent).

A desirable mode is one in which a first treatment agent drying device is provided to dry the first treatment agent, and the second treatment agent and the ink are deposited after the first treatment agent has been dried.

Desirably, the inkjet recording apparatus further comprises: a first treatment agent deposition control device which controls the first treatment agent deposition device ejecting the first treatment agent; and a second treatment agent deposition control device which controls the second treatment agent deposition device ejecting the second treatment agent, wherein: the first treatment agent deposition control device controls the first treatment agent deposition device in such a manner that the first treatment agent is deposited onto a first deposition region of the recording medium including a second deposition region of the recording medium onto which the second treatment agent is deposited and a third deposition region of the recording medium surrounding the second deposition region; and the second treatment agent deposition control device controls the second treatment agent deposition device in such a manner that the second treatment agent is deposited onto an ink droplet ejection region of the ink and a region surrounding the ink droplet ejection region.

According to this aspect of the invention, by depositing the first treatment agent onto the region where the second treatment agent is to be deposited and the region surrounding the region where the second treatment agent is to be deposited, the second treatment agent will be deposited on the deposition region of the first treatment agent and hence it is possible reliably to prevent the second treatment agent from permeating into the recording medium.

Desirably, the first treatment agent deposition device includes a first treatment agent droplet ejection head which ejects droplets of the first treatment agent, and the second treatment agent deposition device includes a second treatment agent droplet ejection head which ejects droplets of the second treatment agent, and the inkjet recording apparatus further comprises: a first treatment agent droplet ejection control device which controls the first treatment agent droplet ejection head ejecting the droplets of the first treatment agent; and a second treatment agent droplet ejection control device which controls the second treatment agent droplet ejection head ejecting the droplets of the second treatment agent.

According to this aspect of the invention, it is possible to apply the first treatment agent and the second treatment agent on a dot by dot basis. Furthermore, since the adherence of the first treatment agent to the non-image portions can be suppressed, it is possible to maintain the appearance of the non-image portions. Moreover, it is also possible to reduce the amount of the first treatment agent consumed in comparison with a case where the first treatment agent is deposited on the whole surface of the recording medium.

A possible mode for the composition of the droplet ejection head is one comprising an ejection port which ejects liquid, a liquid chamber which is connected to the ejection port, and a pressurization device which pressurizes the liquid inside the liquid chamber.

Desirably, the first treatment agent droplet ejection control device controls the first treatment agent droplet ejection head in such a manner that the first treatment agent are ejected onto first droplet ejection points of the recording medium including second droplet ejection points of the recording medium onto which the second treatment agent are ejected and third droplet ejection points of the recording medium which are adjacent to the second droplet ejection points.

According to this aspect of the invention, curl in the recording medium is effectively prevented, and it is also possible to achieve high quality in the recorded image.

A desirable mode is one where the second treatment agent droplet ejection control device controls the second treatment agent droplet ejection head so as to eject droplets of the second treatment agent onto droplet ejection points in a range including the droplet ejection points of the ink droplet ejection head and the droplet ejection points adjacent to the droplet ejection points of the ink droplet ejection head.

Desirably, the first treatment agent droplet ejection control device controls the first treatment agent droplet ejection head in such a manner that the first treatment agent are ejected onto droplet ejection points of the recording medium onto which the second treatment agent are ejected, and dots formed from the droplets of the first treatment agent being larger in size than dots formed from the droplets of the second treatment agent respectively on the droplet ejection points.

According to this aspect of the invention, since the size of the dots of the first treatment agent is made larger than the size of the dots of the second treatment agent, it is possible to prevent curl effectively and to form an image of high quality.

A more desirable mode is one in which the second treatment agent deposition control device controls the droplet ejection of the second treatment agent droplet ejection head so as to form dots of the second treatment agent having a larger size than the dots of ink at the same droplet ejection points as the droplet ejection points where the droplets of ink have been ejected by the ink droplet ejection head, and so as to make the dot sizes of the dots of the first treatment agent, the dots of the second treatment agent, and the dots of ink small in this order.

Desirably, the image processing device generates the dot data for the first treatment agent and the dot data for the second treatment agent from the input image data in such a manner that a droplet ejection density of the first treatment agent is smaller than a droplet ejection density of the second treatment agent.

According to this aspect of the invention, it is possible to eject droplets to form dots of the first treatment agent onto the droplet ejection positions of the second treatment agent, and curl can be prevented effectively as well as achieving high-quality image formation.

Desirably, the inkjet recording apparatus comprises a conveyance device which conveys the recording medium in a conveyance direction, wherein the first treatment agent deposition control device controls the first treatment agent droplet ejection head in such a manner that the droplets of the first treatment agent are ejected onto ink droplet ejection points of the recording medium onto which the ink droplet ejection head ejects the droplets of the ink and downstream droplet ejection points of the recording medium to a downstream side of the ink droplet ejection points in terms of the conveyance direction.

According to this aspect of the invention, since droplet ejection abnormalities are liable to occur in the initial droplet ejection operation in an inkjet method, then by ejecting droplets of the first treatment agent and the second treatment agent prior to ejecting droplets of ink, it is possible to eject the droplets of the first treatment agent reliably onto the droplet ejection area of the second treatment agent, even if droplet ejection abnormalities have occurred in the initial droplet ejection of the first treatment agent and the second treatment agent.

If the second treatment agent deposition control device controls the droplet ejection of the second treatment agent droplet ejection head in such a manner that droplets of the second treatment agent are ejected onto the droplet ejection points to the downstream side of the droplet ejection points where ink droplets are ejected by the ink droplet ejection head, in terms of the direction of conveyance of the recording medium, then even if there is a droplet ejection abnormality in the initial droplet ejection of the second treatment agent droplet ejection head, it is possible reliably to eject droplets of the second treatment agent onto the droplet ejection region of the ink.

Desirably, the inkjet recording apparatus comprises a recording medium judgment device which judges a type of the recording medium, wherein the first treatment agent deposition control device controls the first treatment agent deposition device in such a manner that, when the type of the recording medium judged by the recording medium judgment device is not liable to produce curl, an amount of the first treatment agent deposited onto the recording medium is reduced in comparison with a case where the type of the recording medium judged by the recording medium judgment device is liable to produce curl.

According to this aspect of the invention, since the deposition volume of the first treatment agent is optimized in accordance with the type of the recording medium, then it is possible to prevent curling of the recording medium effectively, as well as achieving high-quality image recording which is free of ink bleeding.

Desirably, the inkjet recording apparatus further comprises: a second treatment agent deposition volume calculation device which calculates a deposition volume of the second treatment agent; and an ink deposition volume calculation device which calculates a deposition volume of the ink, wherein the first treatment agent deposition control device controls the first treatment agent deposition device in such a manner that the first treatment agent is deposited in a case where a sum total of the deposition volume of the second treatment agent and the deposition volume of the ink is equal to or greater than a threshold value, and the first treatment agent is not deposited in a case where the sum total of the deposition device of the second treatment agent and the deposition volume of the ink is less than the threshold value.

According to this aspect of the invention, if the total of the deposition volume of the second treatment agent and the deposition volume of the ink is a small volume, and there is a low possibility of curl occurring in the recording medium, then the deposition of the first treatment agent is controlled in such a manner that the first treatment agent is not deposited, and therefore the amount of the first treatment agent consumed is lowered and changes in the appearance of the recording medium are reduced.

Desirably, the second treatment agent deposition volume calculation device calculates the deposition volume of the second treatment agent from the dot data for the second treatment agent into which the image processing device converts the input image data.

According to this aspect of the invention, since the deposition volume of the second treatment agent is derived by calculation, then the deposition volume of the second treatment agent does not need to be actually measured. The dot data for the second treatment agent can be generated by a method similar to that of the dot data for ink.

A desirable mode is one in which the ink deposition volume calculation device calculates the deposition volume of the ink on the basis of the ink dot data into which the image processing device converts input image data.

Desirably, the second treatment agent volume calculation device calculates the deposition volume of the second treatment agent with respect to each of divisional regions of the recording medium that the recording medium is divided into; the ink deposition volume calculation device calculates the deposition volume of the ink with respect to each of the divisional regions of the recording medium; and the first treatment agent deposition control device controls the first treatment agent deposition device in such a manner that deposition of the first treatment agent is adjusted with respect to each of the divisional regions.

According to this aspect of the invention, the image region is divided into a plurality of regions, the deposition volume of the second treatment agent is calculated respectively for each of the regions, the deposition volume of the ink is also calculated respectively for each of the regions, and furthermore, the deposition of the first treatment agent is controlled respectively for each of the regions. Therefore, the first treatment agent is deposited only onto regions where it is required, and hence the amount of the first treatment agent consumed is reduced and the appearance of the non-image portions can be maintained.

Desirably, the threshold value is set according to the recording medium.

According to this aspect of the invention, the first treatment agent is deposited in an optimal fashion in accordance with the type of the recording medium.

Desirably, the inkjet recording apparatus further comprises an abnormality determination device which determines droplet ejection abnormalities in the ink droplet ejection head, wherein the first treatment agent deposition control device controls the first treatment agent deposition device so as not to deposit the first treatment agent onto positions on the recording medium which correspond to locations of the droplet ejection abnormalities determined by the abnormality determination device.

According to this aspect of the invention, since the first treatment agent is not deposited at a position where an ink droplet has not been ejected due to a droplet ejection abnormality in the ink droplet ejection head, then the ink droplets ejected in the periphery of the location of the droplet ejection abnormality produce bleeding and hence the visibility of the image abnormality, such as banding, caused by the droplet ejection abnormality can be diminished. A particularly beneficial effect is displayed in cases where an image is recorded with a high dot coverage rate in a high-resolution image in which mutually adjacent dots overlap with each other.

Desirably, the first treatment agent deposition control device controls the first treatment agent deposition device so as not to deposit the first treatment agent onto the positions on the recording medium which correspond to the locations of the droplet ejection abnormalities determined by the abnormality determination device and positions adjacent to the positions on the recording medium which correspond to the locations of the droplet ejection abnormalities.

According to this aspect of the invention, even if a droplet ejection abnormality occurs in the ink droplet ejection head, by causing the ink dots surrounding the position corresponding to the droplet ejection abnormality to bleed, it is possible to diminish the visibility of the image abnormality.

Desirably, the first treatment agent contains a liquid in which resin particles are dispersed in a lipid solvent, or a liquid in which a resin is dissolved in a lipid solvent.

According to this aspect of the invention, since the first treatment agent itself has no permeability or low permeability with respect to the recording medium which has permeable characteristics, then this first treatment agent is desirable.

Desirably, the first treatment agent includes wax.

According to this aspect of the invention, a desirable first treatment agent layer is formed on the surface of the recording medium, without the first treatment agent permeating into the recording medium.

In order to attain an object described above, another aspect of the present invention is directed to an image recording method of recording an image by using an ink containing a coloring material onto a recording medium, and the image recording method comprises: a first treatment agent deposition step of depositing a first treatment agent having a function of suppressing permeation of liquid into the recording medium, onto the recording medium; a second treatment agent deposition step of depositing a second treatment agent having a function of aggregating the coloring material contained in the ink or a function of increasing viscosity of the ink, onto the recording medium on which the first treatment agent has been deposited, after the first treatment agent deposition step; and an ink droplet ejection step of ejecting droplets of the ink onto the recording medium on which the second treatment agent has been deposited in accordance with dot data derived from input image data, after the second treatment agent deposition step.

A desirable mode is one which comprises a drying step of drying the first treatment agent after depositing the first treatment agent.

In order to attain an object described above, another aspect of the present invention is directed to an image forming method comprising: a resin solution deposition step of depositing a resin solution in which a resin is dispersed or dissolved, onto a medium; a medium heating step of heating the medium; and an image forming step of ejecting droplets of ink, according to an inkjet method, onto the medium which has been subjected to resin solution deposition processing in the resin liquid deposition step and which has been subjected to heat treatment in the medium heating step in such a manner that an image is formed on the medium by the droplets of the ink.

According to this aspect of the invention, since a resin solution is deposited onto the medium before the ejection of ink droplets and since a resin film is formed on the surface of the medium by heating the medium, then the permeation of the ink solvent into the medium is suppressed and curling of the medium is prevented.

The "medium" in the present invention is a member on which a desired image is formed by ink, and it includes at least a medium having permeable properties, such as paper. Furthermore, the "image" includes an image within the broad concept including a three-dimensional shape, motif, and a pattern.

The "ink" is a liquid which contains at least a coloring material and which forms an image by being fixed on the medium.

It is also possible to carry out the medium heating step before the resin solution deposition step, and it is also possible to carry out the medium heating step from before the resin solution deposition step until during the resin solution deposition step. Furthermore, it is also possible to adopt a composition in such a manner that a medium treatment step is carried out after the resin solution deposition step.

Desirably, relationship between a surface temperature $T_1$ of the medium in the resin liquid deposition step and a minimum film forming temperature $T_{f1}$ of the resin in the resin solution satisfies $T_1>T_{f1}$.

According to this aspect of the invention, by setting the temperature $T_1$ of the medium in the resin liquid deposition step to a temperature exceeding the minimum film formation temperature $T_{f1}$ of the resin contained in the resin solution, then a good resin film is formed on the surface of the medium.

A desirable mode is one which includes a temperature determination step of detecting the surface temperature of the medium (the temperature of the surface where the resin liquid is deposited), and a temperature control step of changing the heating temperature in accordance with the determination results of the temperature determination step. In other words, a desirable mode is one where, during the medium heating step, the surface temperature of the medium is monitored and the temperature conditions stated above are maintained.

The minimum film formation temperature $T_{f1}$ of the resin is a temperature at which at least a portion of the resin contained in the resin solution forms a film.

Desirably, the image forming method further comprises a fixing step of heating the image formed on the medium after the image forming step so as to fix the image on the medium, wherein relationship between a temperature $T_2$ of the image during the fixing step and a glass transition temperature $T_{g1}$ of the resin in the resin solution satisfies $T_2>T_{g1}$.

According to this aspect of the invention, in the image forming step the image (medium) is heated in such a manner that the temperature of the image formed on the medium becomes $T_2$, and reaches a temperature which exceeds the glass transition temperature $T_{g1}$ of the resin contained in the resin solution, whereby the adhesiveness between the image (ink coloring material) on the medium and the resin film is improved.

Desirably, the ink contains a coloring material and a resin component, and relationship between the temperature $T_2$ of the image during the fixing step and a glass transition temperature $T_{g2}$ of the resin component satisfies $T_2>T_{g2}$.

According to this aspect of the invention, since setting the temperature $T_2$ of the image during the fixing step to a temperature which exceeds the glass transition temperature $T_{g2}$ of the resin component contained in the ink, then the resin component contained in the ink is melted (softened) during the fixing step and hence the overall strength of the image is improved.

Desirably, the image forming method further comprises: a treatment liquid deposition step of depositing treatment liquid containing a component which reacts with a coloring material contained in the ink between the resin solution deposition step and the image forming step; and a treatment liquid drying step of drying a solvent contained in the treatment liquid between the treatment liquid deposition step and the image forming step.

According to this aspect of the invention, since a treatment agent which aggregates or insolubilizes the coloring material by reacting the coloring material in the ink is deposited onto the medium where a resin film has been formed on the surface, prior to the image forming step based on the ink droplet ejection, and furthermore, since the treatment liquid film (treatment liquid layer) is formed by drying the treatment agent, then the ink droplets ejected onto the treatment agent layer are rapidly aggregated or insolubilized, and image disturbance caused by coalescence of the dots or movement of the dots is prevented.

Furthermore, it is also possible to prevent image disturbances caused by an effect where the dots do not spread to the prescribed size, which occurs when droplets of ink are ejected onto the treatment agent in a liquid state, or an effect where the dots float in the treatment agent without reaching the recording medium.

Desirably, relationship between a temperature $T_3$ of the medium during the treatment liquid drying step and a glass transition temperature $T_{g1}$ of the resin in the resin solution satisfies $T_3<T_{g1}$.

According to this aspect of the invention, in the treatment liquid drying step, abnormalities (breaks) in the resin film, such as the occurrence of fractures in the resin film, are prevented and a good resin film is maintained.

Desirably, the resin solution contains a high-boiling-point solvent, and the resin solution is deposited by ejecting droplets of the resin solution according to an inkjet method.

According to this aspect of the invention, since a resin solution is deposited onto the medium by an inkjet method, then it is possible to form a resin film only on the necessary region of the medium and the resin film is not formed on the region where the resin film is not required. Therefore, it is possible to prevent changes in the appearance of the medium in such regions.

The high-boiling-point solvent which is not dried substantially at the temperature of the resin solvent during the resin solvent deposition step, and which does not impede the dissolution or dispersion of the resin in the resin solution. More specifically, the solvent is one having a saturated vapor pressure of 1 kPa or lower, and desirably 0.1 kPa or lower, at the temperature of the resin solution in the resin solution deposition step.

Desirably, at least one of the resin solution and the ink is ejected by a single pass method.

According to this aspect of the invention, since the resin film is formed only on the region where the treatment agent and the ink are deposited (the region where an image is formed), then the resin film is not formed on the non-image region and change in the appearance of the medium in the non-image region is prevented.

In order to attain an object described above, another aspect of the present invention is directed to an image forming apparatus comprising: a resin solution deposition device which deposits a resin solution in which a resin is dispersed or dissolved, onto a medium; a medium heating device which heats the medium; and an image forming device which ejects droplets of ink according to an inkjet method onto the medium which has been subjected to a resin liquid deposition processing by the resin liquid deposition device and which has been subjected to a heat treatment by the medium heating device, so as to form an image on the medium.

A desirable mode is one which comprises: a movement device which moves the resin liquid deposition device and the image forming device and the medium relatively with respect to each other; a device which dries the resin liquid on the medium (thereby forming a film) by heating the medium after the deposition of the resin liquid; a drying device which dries the solvent on the medium by heating the medium after the ejection of ink droplets; and a heating and pressurizing fixing device which fixes the image on the medium by heating and pressurizing the image on the medium.

Furthermore, a desirable mode is one which comprises: a treatment liquid deposition device which deposits a treatment liquid that aggregates or insolubilizes the coloring material in the ink by reacting with the ink onto the medium on which the resin solvent has been deposited; and a treatment liquid drying device which dries the treatment liquid (remove the solvent) that has been deposited onto the medium.

According to the present invention, since a first treatment agent which has a function of suppressing the permeation of liquid into the recording medium is deposited on the recording medium, then the second treatment agent which has a function of aggregating the ink and the coloring material in the ink or a function of increasing the viscosity of the ink dots does not permeate into the recording medium, and therefore it is possible to prevent curl which arises due to the permeation of liquid into the recording medium. The present invention displays particular beneficial effects in cases where an image is recorded onto a recording medium having permeable properties.

Furthermore, since a resin solution is deposited onto the medium before the ejection of ink droplets and since a resin film is formed on the surface of the medium by heating the medium, then the permeation of the ink solvent into the medium is suppressed and curling of the medium is prevented.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 16 is a diagram showing evaluation results of a further image forming method according to an embodiment of the present invention;

DETAILED DESCRIPTION OF THE PREFERRED EMBODIMENTS

Description of Image Recording Method

Figure 1A:
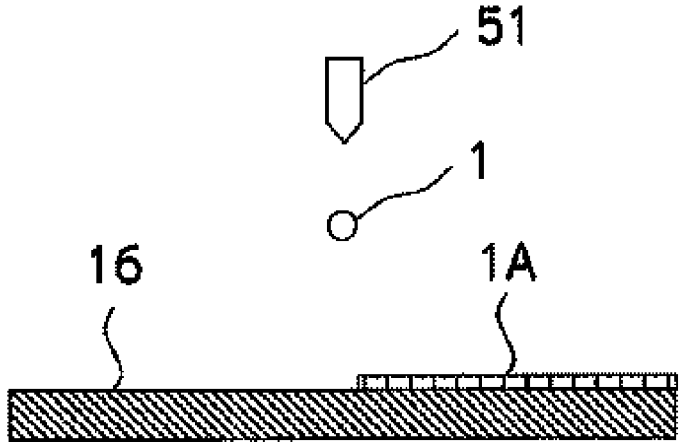
FIGS. 1A to 1C are conceptual diagrams showing an image recording method according to an embodiment of the present invention.
Figure 1B:
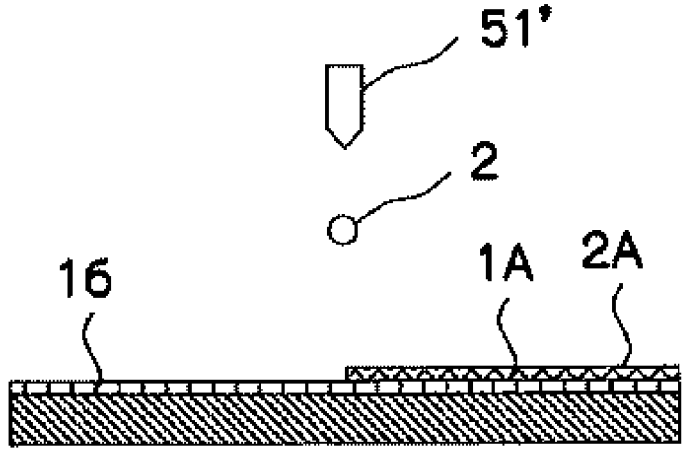
Figure 1C:
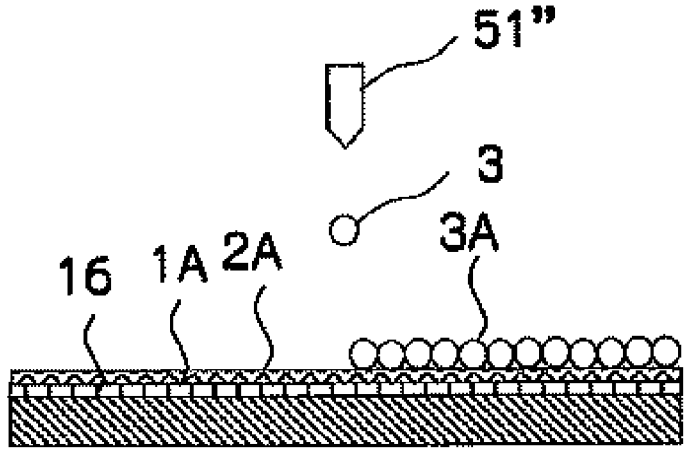

FIGS. 1A to 1C show schematic views of an image recording method relating to an embodiment of the present invention. The image recording method shown in the present embodiment includes: a permeation suppression agent deposition step shown in FIG. 1A; a treatment liquid deposition step shown in FIG. 1B; and an ink droplet ejection step shown in FIG. 1C.

The permeation suppression agent deposition step shown in FIG. 1A deposits a permeation suppression agent which suppresses the permeation of water and hydrophilic organic solvent into the paper 16 (first treatment agent; the permeation suppression agent ejected in the shape of a droplet is indicated by reference numeral 1 in the drawings). The permeation suppression agent used is desirably a solution obtained by dispersing a latex in an organic solution, a solution obtained by dissolving a polymer in an organic solvent, or a wax, or the like. Desirably, the organic solvent used is a non-aqueous solvent such as methyl ethyl ketone or petroleum (a solvent which does itself cause the paper to curl). It may even be possible to use a solvent which causes curl, such as water, depending on the type of paper 16 and the amount of the first treatment agent deposited.

The method of depositing the permeation suppression agent may use droplet ejection based on an inkjet method (FIG. 1A shows a mode where permeation suppression agent is ejected in the form of very fine droplets from nozzles 51), or spray application, roller application, or the like. It is suitable to use an inkjet method since this makes it possible to deposit the permeation suppression agent selectively only onto the positions where droplets of the ink containing coloring material are to be ejected and the periphery of same, as described below. Desirably, after the deposition of the permeation suppression agent, by carrying out a heat treatment the solvent component of the permeation suppression agent is evaporated off and the resin component (latex, dissolved polymer, or the like) is caused to form a skin.

Furthermore, in the treatment liquid deposition step shown in FIG. 1B, a permeation suppression agent layer 1A is formed on the surface of the paper 16 in the permeation suppression agent deposition step, whereupon a material (treatment liquid, second treatment agent; the treatment liquid 2 formed into very fine droplets shown in FIG. 1B) having a component which aggregates or increases the viscosity of the coloring material (pigment or dye) in the ink containing coloring material (indicated by reference numeral 3 in FIG. 1C) described below is deposited.

Possible examples of the treatment liquid include a treatment liquid which precipitates or insolubilizes the coloring material in the ink by reacting with the ink, and a treatment liquid which generates a semi-solid material (gel) that includes the coloring material in the ink, and the like. The method of generating a reaction between the ink and the treatment liquid may be a method which causes an anionic coloring material in the ink to react with a cationic compound in the treatment liquid, a method which aggregates pigment by breaking down the dispersion of the pigment in the ink due to altering the pH of the ink by mixing an ink and a treatment liquid which have different pH values, a method which aggregates pigment by breaking down the dispersion of the pigment in the ink due to a reaction with a polyvalent metal salt contained in the treatment liquid, or the like.

Similarly to the method of depositing the permeation suppression agent, the method of depositing the treatment liquid may suitably use droplet ejection based on an inkjet method (FIG. 1B shows a mode where treatment liquid is ejected in the form of very fine droplets from a nozzle 51'), spray application, roller application, or the like. It is preferable if an inkjet method is adopted, since this makes it possible to deposit the treatment liquid selectively only onto the positions where droplets of ink containing coloring material are to be ejected and the periphery thereof, as described hereinafter.

As described above, since a treatment liquid is deposited at a location where the permeation suppression agent has been deposited beforehand (onto the layer of permeation suppression agent 1A), then it is hard for the treatment liquid to permeate into the interior of the paper 16. After the coloring material component in the ink which is described below has aggregated, in order to prevent this coloring material from floating in the treatment liquid layer 2A rather than become attached to the paper 16 (permeation suppression agent layer 1A), it is desirable that the solvent in the treatment liquid should be dried (evaporated off) after the treatment liquid has been deposited (after the treatment liquid layer 2A is formed).

In the ink droplet ejection step shown in FIG. 1C, ink droplets 3 are ejected from a nozzle 51" in order to form dots 3A which correspond to the input image by means of an inkjet method. In other words, a desired image is recorded on the paper 16 by ejecting ink droplets in accordance with the image data onto the region where the treatment liquid layer 2A has been formed in advance.

According to the image recording method described above, the permeation into the paper 16 of the solvent component of the treatment liquid 2 and the ink droplets 3 is suppressed by the function of the permeation suppression agent, and curl does not arise in the recording medium after image recording. Furthermore, since the treatment liquid 2 is held on the surface of the paper 16 without permeating into the paper 16, then the ink droplets 3 which become attached to the paper 16 (the treatment liquid layer 2A) are fixed swiftly to the surface of the paper 16, and hence the occurrence of image abnormalities such as bleeding of the ink is prevented.

Apparatus Composition

Figure 2:
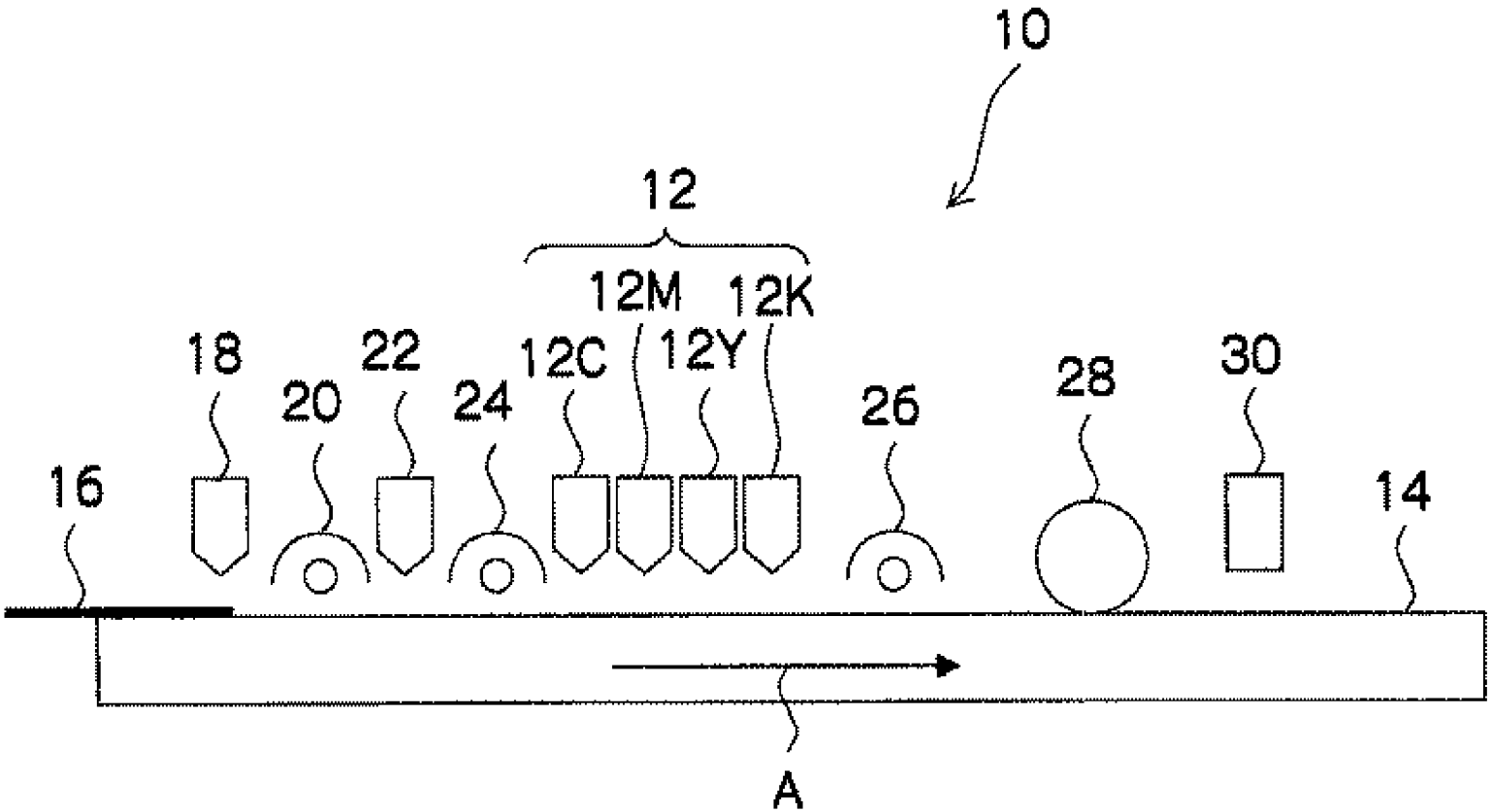
FIG. 2 is a general schematic drawing of an inkjet recording apparatus relating to an embodiment of the present invention.

Next, an image forming apparatus (inkjet recording apparatus) which employs the image recording method shown in FIGS. 1A to 1C will be described. FIG. 2 is a general schematic drawing of the inkjet recording apparatus 10 shown in the present embodiment.

As shown in FIG. 2, the inkjet recording apparatus 10 is an on-demand type of image recording apparatus which records a desired color image by ejecting droplets of inks of the respective colors of C, M, Y and K onto paper 16 which is conveyed in a prescribed paper conveyance direction A by a paper conveyance unit 14, from an ink droplet ejection unit 12 which includes heads 12C, 12M, 12Y, 12K that correspond to the respective colors of C, M, Y and K.

The inkjet recording apparatus 10 comprises: a permeation suppression agent deposition unit 18 which deposits permeation suppression agent (see FIG. 1A) onto paper 16; a permeation suppression agent drying unit 20 which dries the solvent in the permeation suppression agent; a treatment liquid deposition unit 22 which deposits treatment liquid onto the permeation suppression agent layer which has been subjected to the drying process (see FIGS. 1A and 1B); a treatment liquid drying unit 24 which dries the solvent in the treatment liquid; the ink droplet ejection unit 12 which is described above; an ink drying unit 26 which dries the solvent in the ink; and a fixing and heating unit 28 which carries out processing for fixing the ink coloring material onto the paper 16.

In other words, the paper 16 held by the paper conveyance unit 14 is conveyed from left to right in FIG. 2, and firstly, permeation suppression agent is deposited from the permeation suppression agent deposition unit 18, and a drying process is earned out by the permeation suppression agent drying unit 20 which is provided to the downstream side of the permeation suppression agent deposition unit 18 in terms of the paper conveyance direction. Thereupon, treatment liquid is deposited from a treatment liquid deposition unit 22 which is provided on the downstream side of the permeation suppression agent drying unit 20 in terms of the paper conveyance direction, and furthermore, a drying process is carried out by the treatment liquid drying unit 24 which is provided to the downstream side of the treatment liquid deposition unit 22 in terms of the paper conveyance direction.

Next, ink droplets are ejected, in accordance with the image data, from an ink droplet ejection unit 12 which is provided to the downstream side of the treatment liquid drying unit 24 in terms of the paper conveyance direction, and a drying process is carried out by the ink drying unit 26 which is provided to the downstream side of the ink droplet ejection unit 12 in terms of the paper conveyance direction.

Preferably, the paper conveyance unit 14 employs a method such as belt conveyance which holds and conveys the paper 16 on the surface of an endless belt which is wound about a plurality of rollers, and drum conveyance which holds the paper 16 on the outer circumferential surface of a drum and conveys the paper on this outer circumferential surface of the drum by rotating the drum in a prescribed direction of rotation, or the like. Furthermore, for the method of holding the paper 16 on the paper conveyance unit 14, it is possible to employ various methods, such as air adhesion created by suctioning of air, electrostatic attraction created by static electricity, or a method which nips and holds the end of the paper, or the like.

It is suitable to use an inkjet method (inkjet head) for the permeation suppression agent deposition unit 18 and the treatment liquid deposition unit 22 according to the present embodiment. Of course, instead of such an inkjet method, it is also possible to employ an application method using an application member, such as an application roller, or a spraying method.

A common composition is used for the respective drying units of the present embodiment. In other words, in the respective drying units described in the present embodiment, a drying treatment is carried out from above the medium (from the side of the image recording surface of the paper 16). Desirably, the drying process combines the use of infrared drying and air drying. Furthermore, it is also possible to carry out solvent absorption using a porous roller, instead of or in conjunction with the drying of the solvent in the ink. Furthermore, it is also possible to employ a mode in which a heater is incorporated into the structural body which supports the paper 16 (for example, inside the belt or drum).

Since the droplet ejection volume of the ink is greater than the droplet ejection volume of the permeation suppression agent and the droplet ejection volume of the treatment agent, then a desirable mode is one in which the ink drying unit 26 which is provided to the downstream side of the ink droplet ejection unit 12 is composed to have a greater capacity and a stronger drying capability than the other drying processing units.

Desirably, in the fixing and pressurizing unit 28 which is provided to the downstream side of the ink drying unit 26 in terms of the paper conveyance direction, a pressure of approximately 0.5 to 2.0 MPa and a heating temperature of approximately 70 to 100° C. are applied to the aggregate of coloring material, thereby melting the dispersed polymer in the ink and thus strengthening the bond with the paper 16 (the permeation suppression agent layer 1A shown in FIGS. 1A and 1B). Furthermore, it is also possible to carry out a lamination process on the surface (image recording surface) of the paper 16, instead of the fixing and pressurizing unit 28.

A sensor 30 is provided in the paper conveyance direction from the fixing and pressurizing unit 28. The sensor 30 is constituted by an imaging element (CCD) which captures an image which has been recorded on the paper 16. In the inkjet recording apparatus 10 according to the present example, the presence or absence of an abnormality (ink ejection abnormality) is judged respectively for each of colors of the ink droplet ejection unit 12 on the basis of the imaging result from the sensor 30.

The sensor 30 is composed so as to be able to read in a color image. For example, it is possible to provide separate sensors which correspond to the respective colors of RGB filters that correspond to the respective colors of R, G and B, and it is also possible to adopt a composition in which color filters corresponding to the respective colors of R, G and B are disposed in a prescribed arrangement. Furthermore, it is also possible to use a line sensor in which the imaging elements are aligned in one row, or to use an area sensor in which imaging elements are arranged in a two-dimensional configuration.

Although not shown in the drawings, a paper supply unit which supplies paper 16 to the paper conveyance unit 14 is provided in the inkjet recording apparatus 10. In the case of a composition in which papers (recording media) of a plurality of different types can be used (a case where a plurality of magazines which accommodate papers 16 are provided), desirably, an information recording body such as a barcode or wireless tag on which paper type information is recorded is attached to each of the magazines, and the type of recording medium (medium type) used is automatically identified by reading in the information on the information recording body by means of a prescribed reading apparatus, and ink ejection control, treatment liquid deposition control and permeation suppression agent deposition control are carried out in such a manner that suitable ink ejection, deposition of treatment liquid and deposition of permeation suppression agent are carried out in accordance with the type of medium.

If using a long and continuous paper which has been wound in a rolled shape, or the like, a cutter which cuts the paper 16 to a prescribed length is provided to the upstream side of the permeation suppression agent deposition unit 18. To give an example of the composition of the cutter, it has a fixed blade having a length that is equal to or greater than the width of the paper 16 and a circular blade which moves along the fixed blade, the fixed blade being disposed on the rear surface side with respect to the printing surface and the circular blade being disposed on the printing surface side, across the conveyance path of the paper 16 from the fixed blade.

Furthermore, although not shown in the drawings, an ink storing and loading unit which supplies ink to the respective heads 12C, 12M, 12Y and 12K of the ink droplet ejection unit 12 is provided in the inkjet recording apparatus 10. The ink storage and loading unit comprises ink supply tanks (indicated by reference numeral 60 in FIG. 7) which store inks of the colors corresponding to the respective heads 12C, 12M, 12Y and 12K, and the inks of the respective colors are connected to the heads 12C, 12M, 12Y and 12K via prescribed ink flow channels. The ink storing and loading unit also comprises a warning device (for example, a display device or an alarm sound generator) for warning when the remaining amount of any ink is low, and uses a member/mechanism having a mechanism for preventing loading errors between different colors.

Similarly to the ink storing and loading unit described above, a composition for supplying a permeation suppression agent to the permeation suppression agent deposition unit 18 is provided, and a composition for supplying a treatment liquid to the treatment liquid deposition unit 22 is also provided. Furthermore, apart from the composition described above, the inkjet recording apparatus 10 described in the present embodiment comprises: a cleaning treatment unit which removes soiling from the surface which holds the paper in the paper conveyance unit 14; a position determination sensor which determines the position of the paper 16 on the paper conveyance path; temperature sensors which determine temperatures of the respective sections of the apparatus, such as the periphery of the ink droplet ejection unit 12; a paper output unit which outputs the paper 16 after image recording, to the exterior of the apparatus; and a movement mechanism which moves the respective units described above between a position on the paper conveyance path and a prescribed withdrawal position; and the like.

Description of Print Unit

Figure 3:
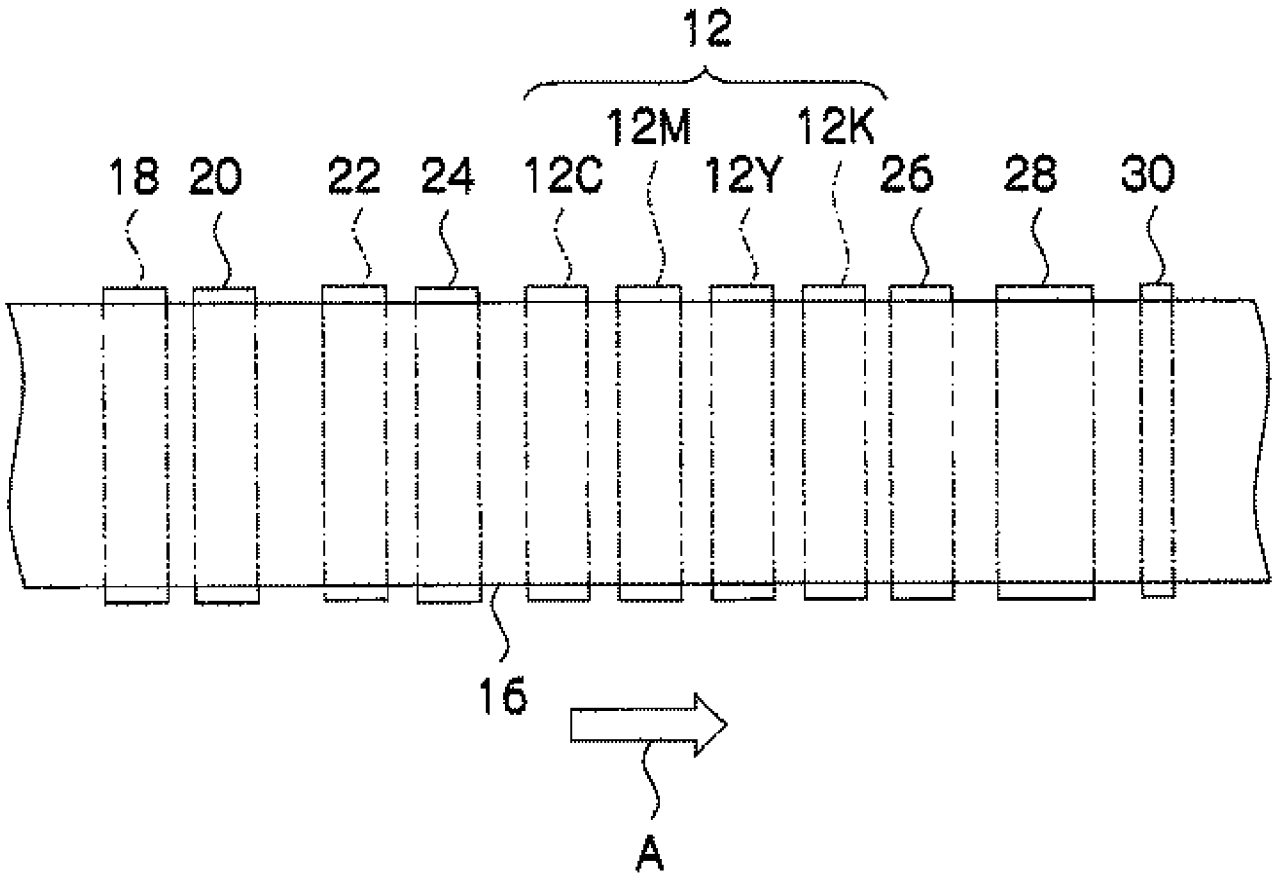
FIG. 3 is a principal plan diagram of the peripheral area of a print unit in the inkjet recording apparatus illustrated in FIG. 2.

Next, the ink droplet ejection unit 12 will be described. As shown in FIG. 3, the heads 12C, 12M, 12Y and 12K of the ink droplet ejection unit 12 are each full-line heads having a length corresponding to the maximum width of the image forming region of the intermediate transfer body 16, and having a plurality of nozzles for ejecting ink (indicated by reference numeral 51 in FIGS. 4A to 4C) arranged through the full width of the image forming region.

The heads 12C, 12M, 12Y and 12K are disposed in the color order, cyan (C), magenta (M), yellow (Y) and black (K), from the upstream side following the direction of conveyance of the paper 16 (the sub-scanning direction; the arrow indicated by reference "A"), and the respective heads 12C, 12M, 12Y and 12K are fixed so as to extend in the direction (the main scanning direction) perpendicular to the paper conveyance direction.

According to a composition where full line type heads having nozzle rows covering the full width of the paper 16 are provided respectively for each color of ink, it is possible to form an image on the image recording region of the paper 16 by performing just one operation of moving the paper 16 and the heads 12C, 12M, 12Y and 12K of the ink droplet ejection unit 12 relatively with respect to each other, in the paper conveyance direction (in other words, by means of one sub-scanning action). Accordingly, it is possible to achieve higher speed printing compared to a serial (shuttle) type of head in which the heads 12C, 12M, 12Y and 12K are moved back and forth reciprocally in the main scanning direction which is perpendicular to the paper conveyance direction, and therefore the print productivity can be improved.

Although a configuration with four standard colors of C, M, Y and K is described in the present embodiment, the combinations of the ink colors and the number of colors are not limited to those. Light and/or dark inks, and special color inks can be added as required. For example, a configuration is possible in which ink heads for ejecting light-colored inks, such as light cyan and light magenta, are added, and there is no particular restriction on the arrangement sequence of the heads of the respective colors.

Structure of the Head

Next, the structure of the heads 12C, 12M, 12Y and 12K is explained in detail. Since the heads 12C, 12M, 12Y and 12K have a common structure, then the heads are represented below by the reference numeral 50. Since a similar composition to the head 50 can also be employed for the inkjet head (permeation suppression agent head) contained in the permeation suppression agent deposition unit 18 and the inkjet head (treatment agent head) contained in the treatment agent deposition unit 22, then the inkjet heads included in the inkjet recording apparatus 10 according to the present embodiment are described with reference to the heads 12C, 12M, 12Y and 12K.

Figure 4A:
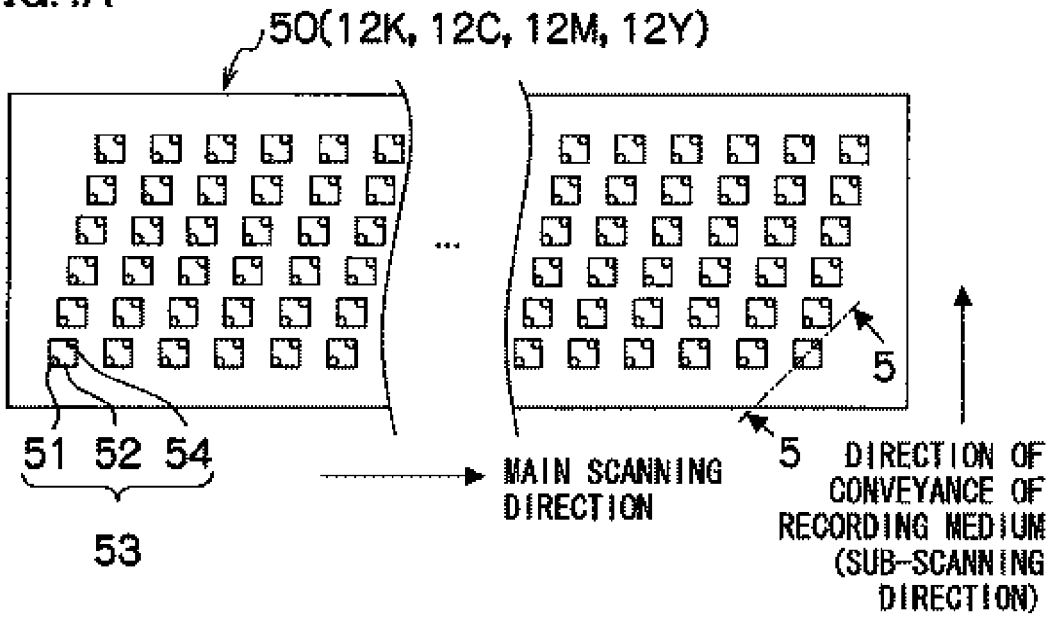
FIGS. 4A to 4C are plan view perspective diagrams showing examples of the composition of the head shown in FIG. 2.
Figure 4B:
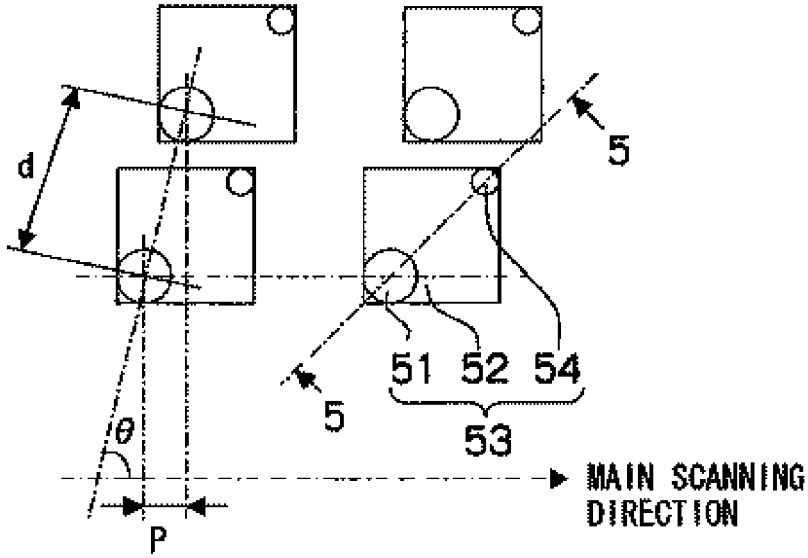
Figure 4C:
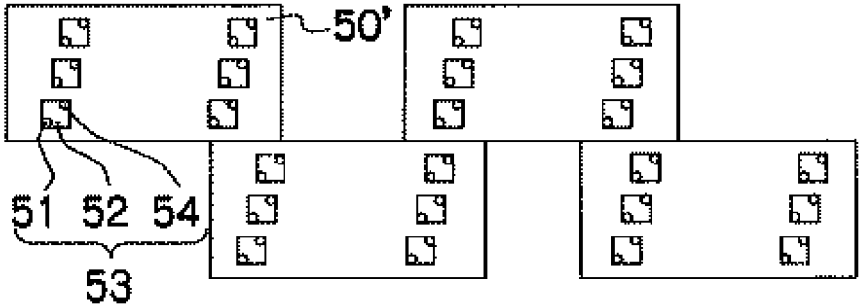
Figure 5:
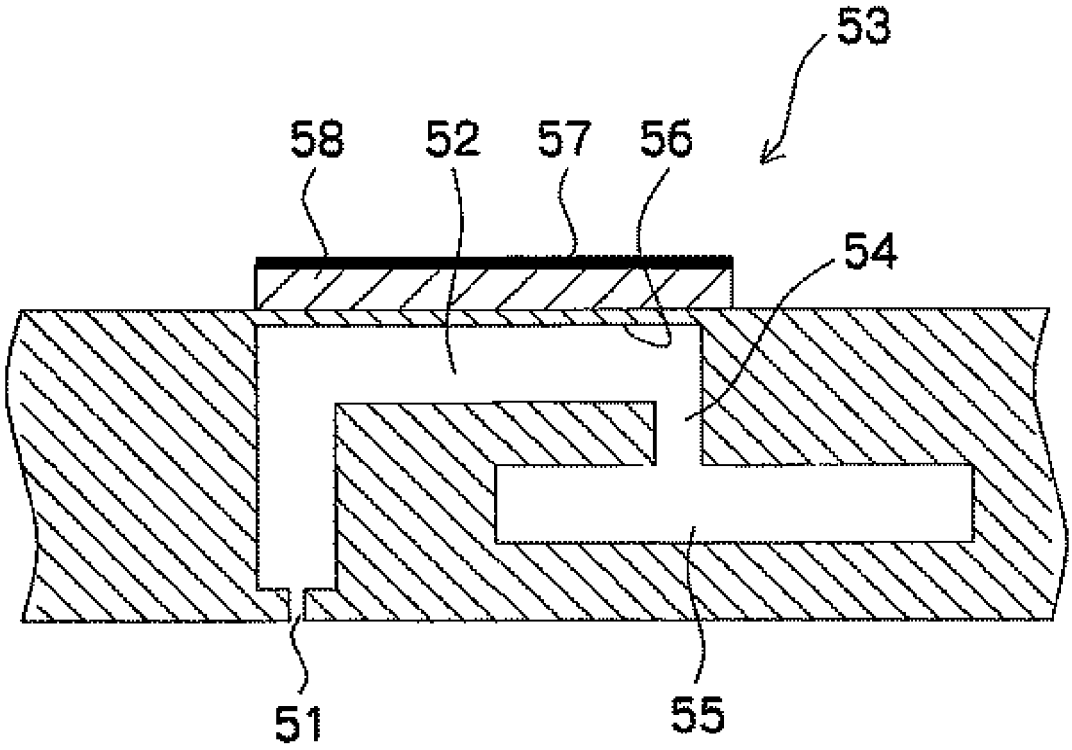
FIG. 5 is a cross-sectional diagram along line 5-5 in FIGS. 4A and 4B.

FIG. 4A is a plan view perspective diagram showing an example of the structure of a head 50, and FIG. 4B is an enlarged diagram of a portion of same. Furthermore, FIG. 4C is a plan view perspective diagram showing a further example of the composition of a print head 50, and FIG. 5 is a cross-sectional diagram showing a composition of an ink chamber unit (being a cross-sectional view along line 5-5 in FIGS. 4A and 4B).

The nozzle pitch in the head 50 should be minimized in order to maximize the density of the dots printed on the surface of the recording paper 16. As shown in FIGS. 4A and 4B, the head 50 according to the present embodiment has a structure in which a plurality of ink chamber units 53, each comprising a nozzle 51 forming an ink droplet ejection port, a pressure chamber 52 corresponding to the nozzle 51, and the like, are disposed in the form of a staggered matrix (two-dimensionally), and hence the effective nozzle interval (the projected nozzle pitch) as projected in the lengthwise direction of the head (the sub-scanning direction) is reduced and high nozzle density is achieved.

An embodiment constituting one or more nozzle rows covering a length corresponding to the full width of the paper 16 is not limited to the present example. For instance, instead of the composition in FIG. 4A, as shown in FIG. 4C, a line head having nozzle rows of a length corresponding to the entire length of the paper 16 can be formed by arranging and combining, in a staggered matrix, short head modules 50' having a plurality of nozzles 51 arrayed in a two-dimensional fashion. Furthermore, although not shown in the drawings, it is also possible to compose a line head by arranging short head modules in one row.

The pressure chambers 52 provided corresponding to the respective nozzles 51 are approximately square-shaped in plan view, and a nozzle 51 and a supply port 54 are provided respectively at either corner of a diagonal of each of the pressure chambers 52. As shown in FIG. 5, each pressure chamber 52 is connected to a common channel 55 through the supply port 54. The common channel 55 is connected to an ink supply tank (not shown in FIG. 5, but shown in FIG. 7 by reference numeral 60), which is a base tank that supplies ink, and the ink supplied from the ink supply tank 60 is delivered through the common flow channel 55 in FIG. 5 to each of the pressure chambers 52.

Piezoelectric actuators 58 each provided with an individual electrode 57 are joined to a pressure plate 56 which forms the upper face of the pressure chamber 52 and serves as a common electrode. Each piezoelectric actuator 58 is deformed when a drive voltage is supplied to the corresponding individual electrode 57, thereby causing ink to be ejected from the corresponding nozzle 51. When ink is ejected, new ink is supplied to the corresponding pressure chamber 52 from the common flow passage 55, via the corresponding supply port 54.

Figure 6:
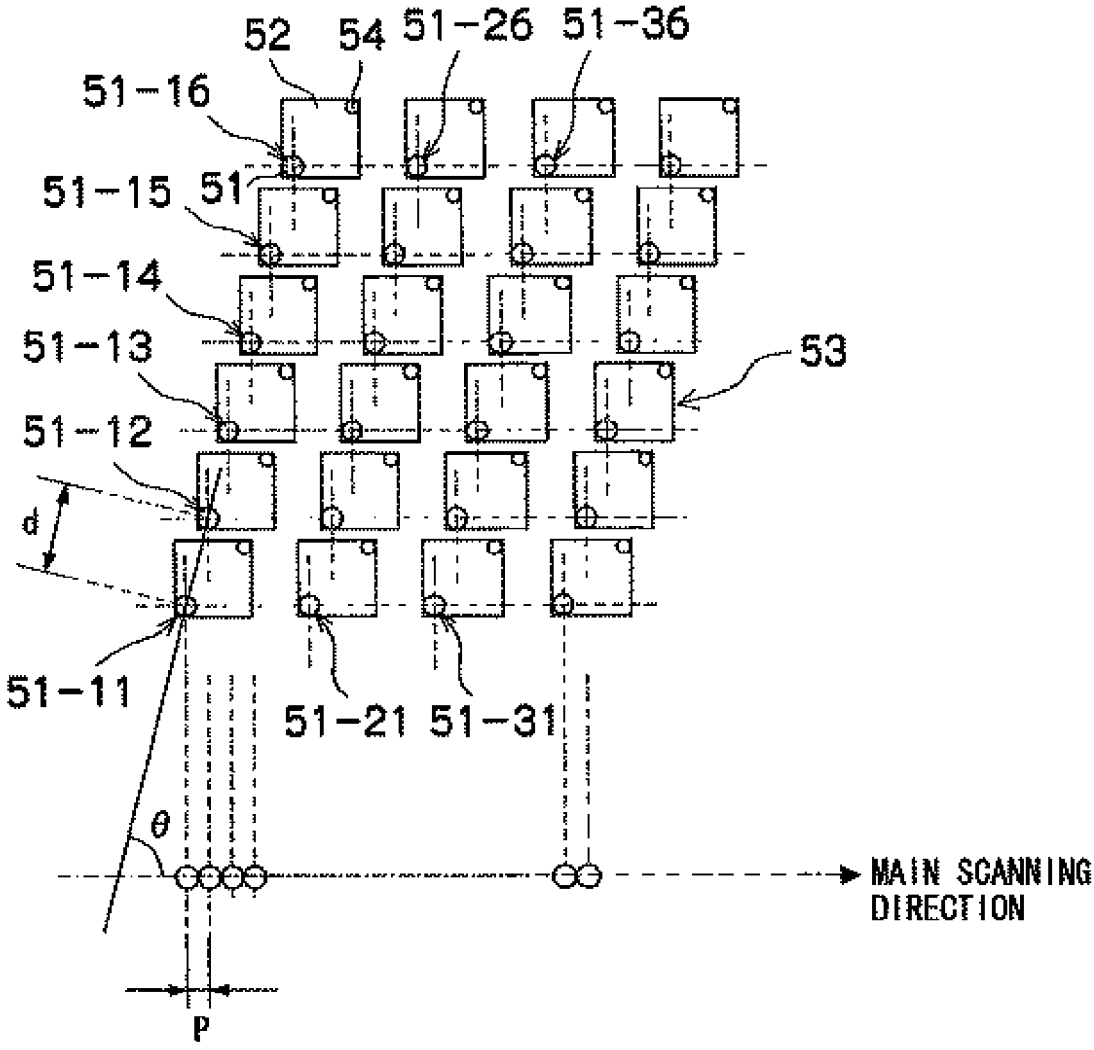
FIG. 6 is an enlarged view showing a nozzle arrangement in the print head illustrated in FIGS. 4A to 4C.

As shown in FIG. 6, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is d×cos θ, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper 16 (the direction perpendicular to the conveyance direction of the recording paper 16) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIGS. 4A and 4B are driven, the main scanning according to the above-described "(3)" method is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by the main scanning as described above is called the "main scanning direction", and the direction in which the sub-scanning is performed, is called the "sub-scanning direction". When implementing the present invention, the arrangement of the nozzles is not limited to that of the examples illustrated.

In implementing the present invention, the arrangement of the nozzles is not limited to that of the example illustrated.

Moreover, a method is employed in the present embodiment where ink droplets are ejected by means of the deformation of piezoelectric actuators 58, which are typically piezoelectric elements; however, in implementing the present invention, the method used for discharging ink is not limited in particular, and instead of the piezo jet method it is also possible to apply various types of methods, such as a thermal jet method where the ink is heated and bubbles are caused to form therein by means of a heat generating body such as a heater, ink droplets being ejected by means of the pressure applied by these bubbles.

The scope of application of the present invention is not limited to a printing system based on a line type of head, and it is also possible to adopt a serial system where a short head which is shorter than the breadthways dimension of the paper 16 is scanned in the breadthways direction of the paper 16, thereby performing printing in the breadthways direction, and when one printing action in the breadthways direction has been completed, the paper 16 is moved through a prescribed amount in the direction perpendicular to the breadthways direction, printing in the breadthways direction of the paper 16 is carried out in the next printing region, and by repeating this operation, printing is performed over the whole surface of the printing region of the paper 16.

Configuration of a Supply System

Figure 7:
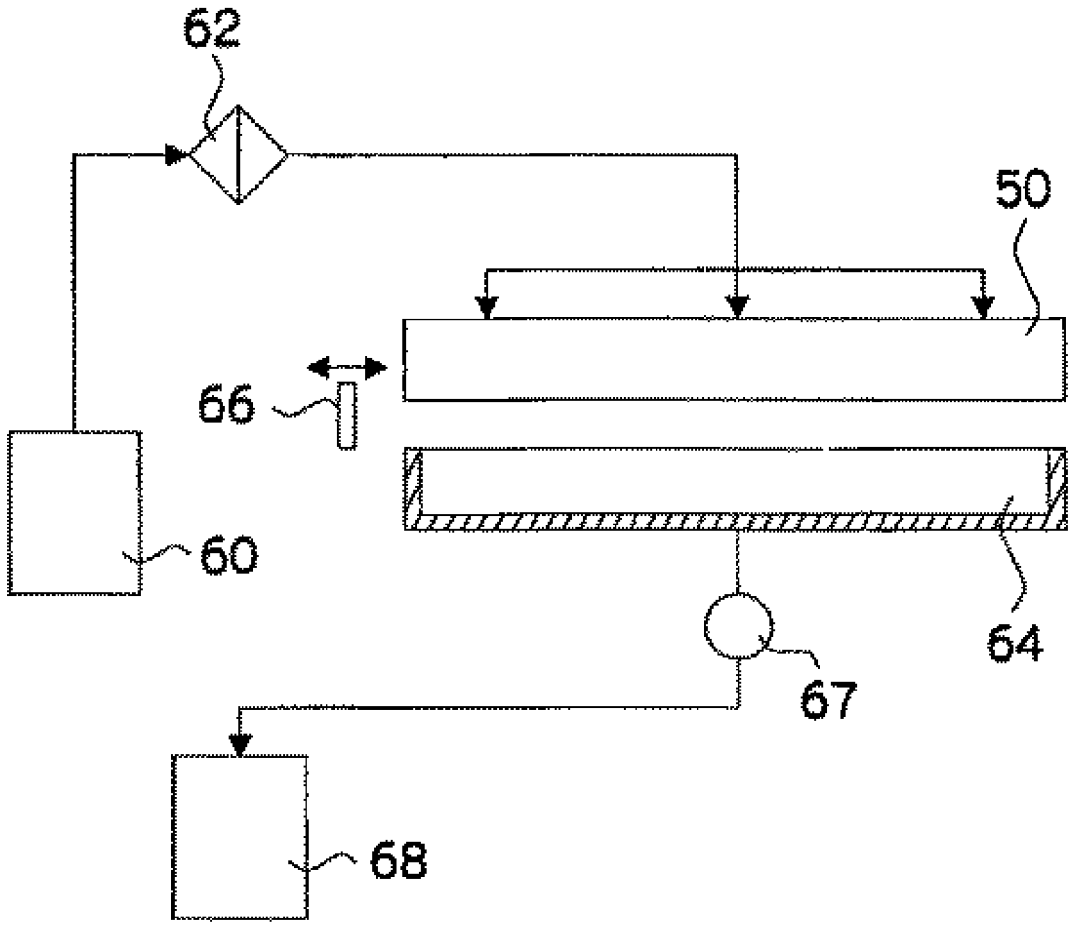
FIG. 7 is a schematic drawing showing the composition of an ink supply system in the inkjet recording apparatus shown in FIG. 2.

FIG. 7 is a schematic drawing showing the configuration of the supply system of ink (permeation suppression agent, treatment liquid) in the inkjet recording apparatus 10. The ink supply tank 60 is a base tank that supplies ink to the head 50 and is included in the ink storing and loading unit described above. The aspects of the irk supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed between the ink supply tank 60 and the head 50 as shown in FIG. 7. The filter mesh size in the filter 62 is preferably equivalent to or less than the diameter of the nozzle and commonly about 20 μm.

Although not shown in FIG. 7, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the ink-droplet ejection face of the head 50.

A maintenance unit (maintenance device) including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap 64.

During printing or standby, if the use frequency of a particular nozzle 51 is low, and if a state of not ejecting ink continues for a prescribed time period or more, then the solvent of the ink in the vicinity of the nozzle evaporates and the viscosity of the ink increases. In a situation of this kind, it will become impossible to eject ink from the nozzle 51, even if the piezoelectric actuator 58 is operated.

Therefore, before a situation of this kind develops (namely, while the ink is within a range of viscosity which allows it to be ejected by operation of the piezoelectric actuator 58), the piezoelectric actuator 58 is operated, and a preliminary ejection ("purge", "blank ejection", "liquid ejection" or "dummy ejection") is carried out toward the cap 64 (ink receptacle), in order to expel the degraded ink (namely, the ink in the vicinity of the nozzle which has increased viscosity).

Furthermore, if air bubbles enter into the ink inside the head 50 (inside the pressure chamber 52), then even if the piezoelectric actuator 58 is operated, it will not be possible to eject ink from the nozzle. In a case of this kind, the cap 64 is placed on the head 50, the ink (ink containing air bubbles) inside the pressure chamber 52 is removed by suction, by means of a suction pump 67, and the ink removed by suction is then supplied to a recovery tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 52, the ink consumption is considerably large. Therefore, desirably, preliminary ejection is carried out when the increase in the viscosity of the ink is still minor.

The cleaning blade 66 is composed of rubber or another elastic member, and can slide on the ink ejection surface of the head 50 by means of a blade movement mechanism (not illustrated). If ink droplets or foreign material become attached to the ink ejection surface, then the ink ejection surface is wiped and thereby cleaned, by moving the cleaning blade 66 over the ink ejection surface.

Description of Control System

Figure 8:
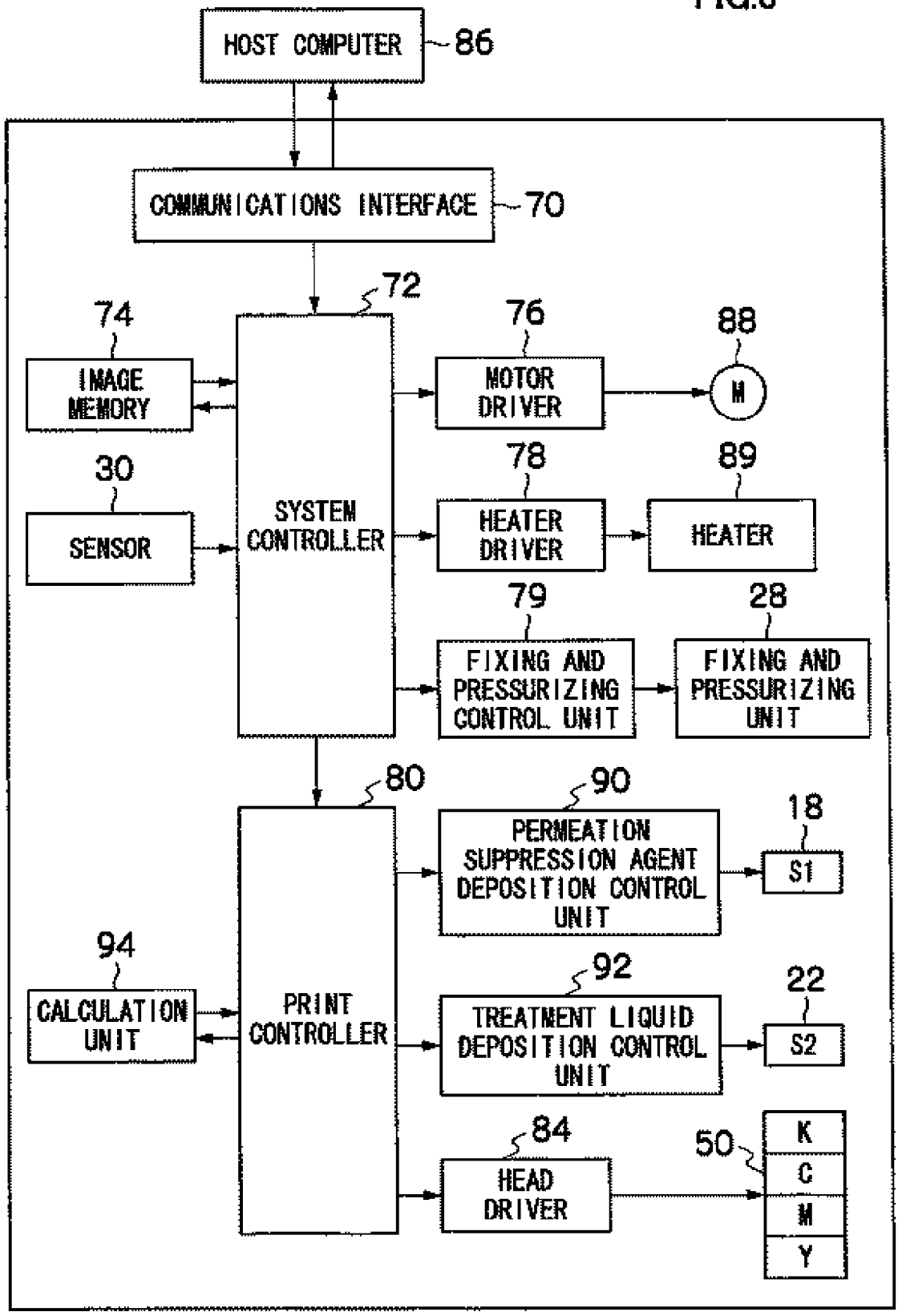
FIG. 8 is a principal block diagram showing the system configuration of the inkjet recording apparatus shown in FIG. 2.

FIG. 8 is a principal block diagram showing a system composition of the inkjet recording apparatus 10. The inkjet recording apparatus 10 comprises: a communications interface 70, a system controller 72, an image memory 74, a motor driver 76, a heater driver 78, a fixing and pressurization control unit 79, a print controller 80, an image buffer memory (not illustrated), a head driver 84, a permeation suppression agent control unit 90, a treatment liquid deposition control unit 92, and a calculation unit 94, and the like.

The communications interface 70 is an interface unit for receiving image data sent from a host computer 86. A serial interface such as USB (Universal Serial Bus), IEEE1394, Ethernet (registered trademark), wireless network, or a parallel interface such as a Centronics interface may be used as the communications interface 70. A buffer memory (not shown) may be mounted in this portion in order to increase the communication speed. The image data transmitted from the host computer 86 is sent into the inkjet recording apparatus 10 via the communications interface 70 and stored in the image memory 74 temporarily.

The image memory 74 is a storage device which temporarily stores image data input via the communications interface 70, image reading data which has been read in by the sensor 30, data which has been processed by the calculation unit 94 (the image after image processing), and the like. Data is read from and written to the image memory 74 via the system controller 72. The image memory 74 is not limited to being a memory constituted by semiconductor elements, and may also use a magnetic medium, such as a hard disk.

The system controller 72 is constituted by a central processing unit (CPU) and peripheral circuits thereof and the like, and it functions as a control device for controlling the whole of the inkjet recording apparatus 10 in accordance with prescribed programs, as well as a calculation device for performing various calculations. More specifically, the system controller 72 controls the various sections, such as the communications interface 70, image memory 74, motor driver 76, heater driver 78, and the like, as well as controlling communications with the host computer 86 and writing and reading to and from the image memory 74, and it also generates control signals for controlling the motor 88 of the conveyance system and a heater 89.

Programs executed by the CPU of the system controller 72 and the various types of data which are required for control procedures are stored in the image memory 74. The image memory 74 may be a non-writeable storage device, or it may be a rewriteable storage device, such as an EEPROM. The image memory 74 is used as a temporary storage region for the image data, and it is also used as a program development region and a calculation work region for the CPU. Furthermore, it is also possible to use a memory which is incorporated into one of the processors constituting the system controller 72, or the like, as the image memory 74.

The motor driver 76 is a driver which drives the motor 88 in accordance with instructions from the system controller 72. In FIG. 8, the motors (actuators) disposed in the respective sections of the apparatus are represented by reference numeral 88. For example, the motor 88 shown in FIG. 8 includes a motor which functions as a drive source for the paper conveyance unit 14 in FIG. 2, motors of the movement mechanisms of the respective units, the motors of the mechanism which moves the cleaning blade 66 in FIG. 7, and so on.

The heater driver 78 is a driver which drives the heater 88 in accordance with instructions from the system controller 72. In FIG. 8, a plurality of heaters which are provided in the inkjet recording apparatus 10 are represented by the reference numeral 89. For example, the heater 89 shown in FIG. 8 includes a heater of the permeation suppression agent drying unit 20 in FIG. 2, a heater of the treatment liquid drying unit 24 in FIG. 2, a heater of the ink drying unit 26 in FIG. 2, and the like.

The print controller 80 is a control unit which has signal processing functions for carrying out, according to the control of the system controller 72, processing, correction, and other processing in order to generate a print control signal on the basis of the image data in the image memory 74, and which supplies print data (dot data) thus generated to the head driver 84, the permeation suppression agent control unit 90 and the treatment liquid deposition control unit 92. Required signal processing is carried out in the print controller 80, and the ejection volume and the ejection timing of the ink droplets by means of the head 50 are controlled via the head driver 84 on the basis of the image data. By this means, desired dot sizes and dot positions can be achieved. Furthermore, the deposition volume and the deposition timing of the permeation suppression agent from the permeation suppression agent deposition unit 18 is controlled via the permeation suppression agent control unit 90 on the basis of the image data, and furthermore, the deposition volume and deposition timing of the treatment liquid deposition unit 22 is controlled via the treatment liquid deposition control unit 92.

An image buffer memory (not illustrated) is provided in the print controller 80, and image data, parameters, and other data are temporarily stored in the image buffer memory when image data is processed in the print controller 80. Also possible is a mode in which the print controller 80 and the system controller 72 are integrated to form a single processor.

The head driver 84 generates drive signals to be applied to the piezoelectric actuators 58 of the heads 12C, 12M, 12Y and 12K, on the basis of image data supplied from the print controller 80, and also comprises drive circuits which drive the piezoelectric actuators 58 by applying the drive signals to the piezoelectric actuators 58. A feedback control system for maintaining constant drive conditions in the head 50 may be included in the head driver 84 shown in FIG. 8.

The image data to be printed is externally inputted through the communications interface 70, and is stored in the image memory 74. In this stage, the RGB image data is stored in the image memory 74.

The image data stored in the image memory 74 is sent to the print controller 80 via the system controller 72, and is converted by the print controller 80 into dot data for the respective ink colors. In other words, the print controller 80 performs RIP processing for converting the input RGB raster data into dot data for the four colors of K, C, M and Y. The dot data generated by the print controller 80 is stored in the image buffer memory (not illustrated). The dot data for the permeation suppression agent and the dot data for the treatment liquid are also generated in a similar fashion.

The calculation unit 94 is a block which has a function for carrying out prescribed signal processing on the determination signals obtained from the sensor 30. For example, information on dot defects (shape abnormalities, positional abnormalities) is generated from the read signal of the sensor 30, and this ejection abnormality information is supplied to the print controller 80. The print controller 80 performs correction of the image data (dot data) on the basis of the ejection abnormality information.

Various control programs are stored in a program storage section (not illustrated), and a control program is read out and executed in accordance with commands from the system controller 72. The program storage section may use a semiconductor memory, such as a ROM, EEPROM, or a magnetic disk, or the like. An external interface may be provided, and a memory card or PC card may also be used. Naturally, a plurality of these storage media may also be provided. The program storage section may also serve as a storage device for storing operational parameters, and the like (not shown).

Description of Method of Depositing Permeation Suppression Agent and Treatment Liquid Next, the method of depositing the permeation suppression agent and the treatment liquid will be described in detail. As stated previously, it is possible to use a full surface application method, such as roller application, for the permeation suppression agent and the treatment liquid, but in the present embodiment, it is also possible to eject droplets of treatment liquid onto the ink, in a dot on dot fashion, by adopting an inkjet method, and furthermore, since the permeation suppression agent can be ejected as droplets, in a dot on dot fashion, onto the treatment liquid, it is possible to maintain an unaltered appearance in the non-image portions (the portions where ink dots are not arranged) and a contribution is also made to reducing the amount of treatment liquid and permeation suppression agent consumed.

Figure 9A:
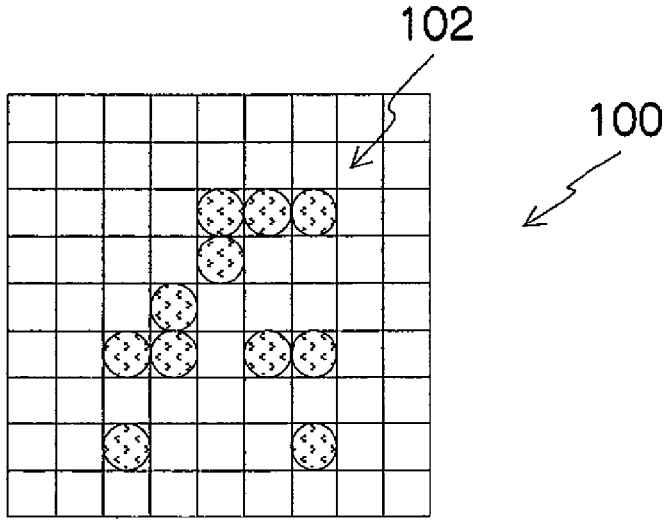
FIGS. 9A to 9C are conceptual diagrams showing the dot arrangement in an image recording method relating to an embodiment of the present invention.
Figure 9B:
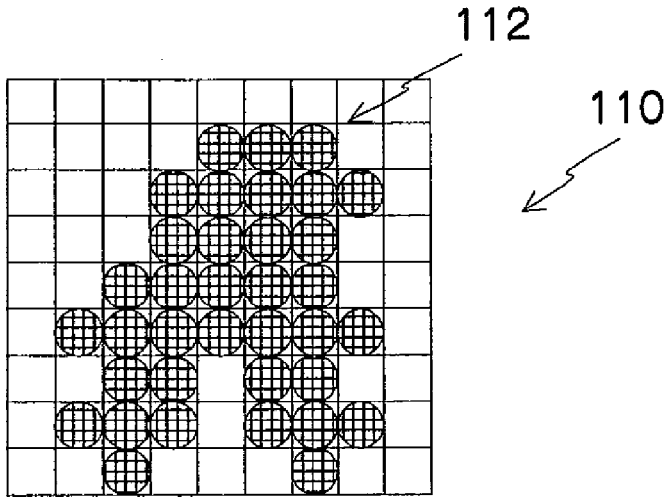
Figure 9C:
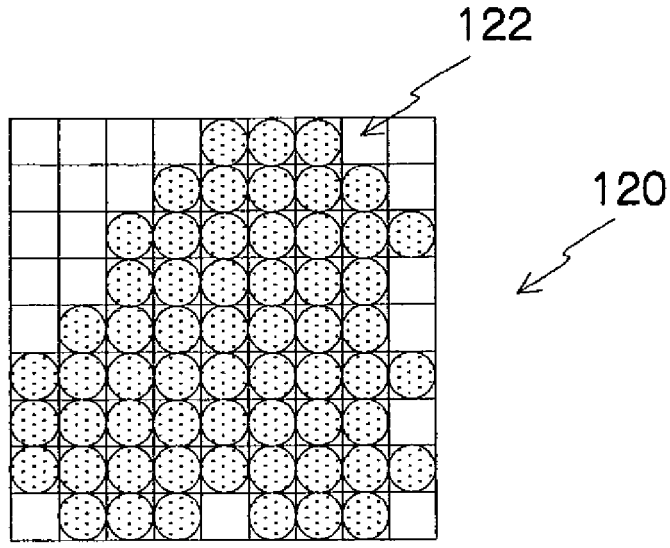

Moreover, in the droplet ejection method described below, a system is described in which the treatment liquid and the permeation suppression agent are deposited selectively only onto the droplet ejection positions of the ink containing coloring material and the periphery of same. FIGS. 9A to 9C show schematic views of an example of the deposition of ink, treatment liquid and permeation suppression agent.

The dot arrangement 100 in FIG. 9A indicates the arrangement of the dots 102 created by ink. The ink dots are the logical sum of the respective colors of C, M, Y and K, and a dot is arranged whenever a dot of any one color of the respective colors of C, M, Y and K is present. Furthermore, the dot arrangement 110 shown in FIG. 9B indicates the arrangement of the dots 112 created by treatment liquid, and the dot arrangement 120 shown in FIG. 9C indicates the arrangement of dots 122 created by permeation suppression agent.

FIGS. 9A to 9C show a mode where the deposition surface area becomes smaller in the order: permeation suppression agent, treatment liquid and ink. In other words, a desirable composition is one in which droplets of treatment liquid are ejected onto the ink droplet ejection region shown in FIG. 9A (the region where the ink dots 102 are formed) and the periphery thereof (namely, treatment liquid dots 112 are formed as shown in FIG. 9B), and droplets of permeation suppression agent are ejected onto the treatment liquid droplet ejection region (the region where the treatment liquid dots 112 are formed) and the periphery thereof (namely, permeation suppression agent dots 122 are formed).

In the example depicted, the method of ejecting droplets of treatment liquid onto the periphery of the ink droplet ejection region and the method of ejecting droplets of permeation suppression agent onto the periphery of the treatment liquid droplet ejection region involve ejecting droplets of treatment liquid onto the ink droplet ejection portion (the ink droplet ejection points, the portion where the ink dots 102 are formed) and to the upper, lower, right-hand and left-hand sides of same, and ejecting droplets of permeation suppression agent onto the treatment liquid droplet ejection portion (the treatment liquid droplet ejection points, the portion where the treatment liquid dots 112 are formed) and to the upper, lower, right-hand and left-hand sides of same. In addition to the upper, lower, right-hand and left-hand sides, it is also possible to add the upper right-hand diagonal side, the upper left-hand diagonal side, the lower right-hand diagonal side, and the lower left-hand diagonal side. Here, the "droplet ejection point" means a position where a dot can be formed on the image (on the paper).

In other words, the mode shown in FIGS. 9A to 9C shows a method of determining the droplet ejection points of the ink, the treatment liquid and the permeation suppression agent, in which the sizes of the dots created by the ink, the dots created by the treatment liquid, and the dots created by the permeation suppression agent are not changed, and the droplet ejection points of the treatment liquid are increased in number with respect to the droplet ejection points of the ink, in such a manner that droplets of the treatment liquid are ejected onto droplet ejection points surrounding the ink droplet ejection points including the droplet ejection points which are adjacent to the ink droplet ejection points, and furthermore, the droplet ejection points of the permeation suppression agent are also increased in number with respect to the droplet ejection points of the treatment liquid.

In other words, in the mode shown in FIGS. 9A to 9C, the treatment liquid dots 112 are formed so as to surround the perimeter of the ink dots 102, and furthermore, the permeation suppression agent dots 122 are formed so as to surround the perimeter of the treatment liquid dots 112. FIGS. 9A to 9C show an example of a mode in which a treatment liquid droplet ejection region corresponding to one dot is provided to the outer side of the ink droplet ejection region, and a permeation suppression agent droplet ejection region corresponding to one dot is further provided to the outer side of the treatment liquid droplet ejection region, but it is also possible to provide a treatment liquid droplet ejection region of two dots or more to the outer side of the ink droplet ejection region, or to provide a permeation suppression agent droplet ejection region of two dots or more to the outer side of the treatment liquid droplet ejection region, such decisions being made appropriately in accordance with the image being recorded (the density of ink dots in the recorded image).

According to the mode shown in FIGS. 9A to 9C, droplets of permeation suppression agent are ejected prior to the treatment liquid so as to surround the droplet ejection region of the treatment liquid, and therefore curling of the paper 16 is prevented reliably since the treatment liquid is not deposited onto a region where the permeation suppression agent is not present. Furthermore, since the droplets of the treatment liquid are ejected prior to the ink so as to surround the droplet ejection region of the ink, then it is possible to cause the ink and treatment liquid to react together reliably without the ink being deposited onto a region where treatment liquid is not present.

Figure 10A:
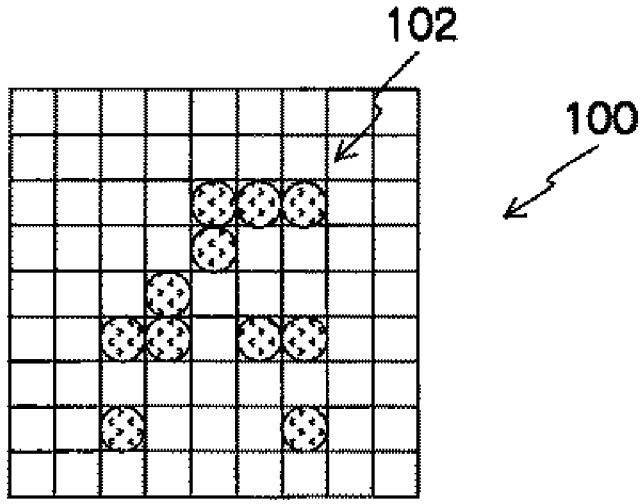
FIGS. 10A to 10C are conceptual diagrams showing a further mode of the dot arrangement shown in FIGS. 9A to 9C.
Figure 10B:
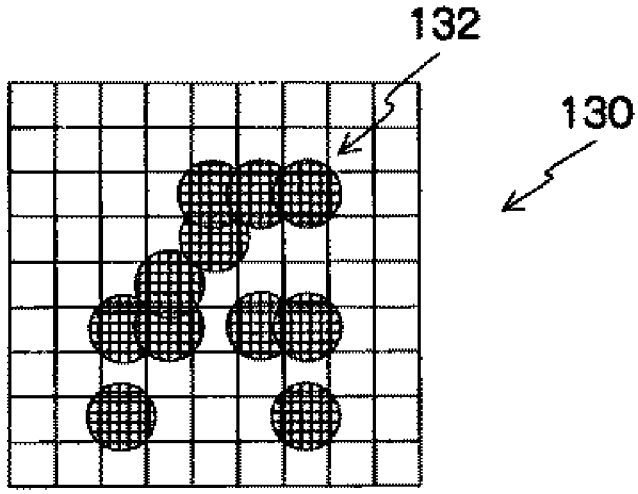
Figure 10C:
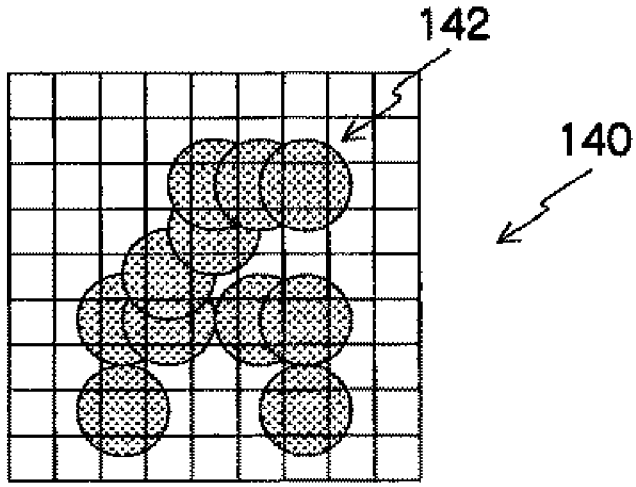

FIGS. 10A to 10C show an example of a dot arrangement in a case where the droplet ejection volume is increased in order, from the ink, to the treatment liquid to the permeation suppression agent. In other words, FIGS. 10A to 10C show a mode where the number of dots of the treatment liquid and the permeation suppression agent is not changed, and the size of the treatment liquid dots 132 and the permeation suppression agent dots 142 is changed. The dot arrangement 100 shown in FIG. 10A is the same as the dot arrangement of the ink dots 102 shown in FIG. 9A, and the description thereof is omitted here.

The dot arrangement 130 shown in FIG. 10B represents the arrangement of the treatment liquid dots 132, and these treatment liquid dots 132 are formed at the same droplet ejection points of the ink dots 102 shown in FIG. 10A, and they have a larger size than the ink dots 102. Furthermore, the dot arrangement 140 shown in FIG. 10C represents the dot arrangement of the permeation suppression agent dots 142, and these permeation suppression agent dots 142 are formed at the same droplet ejection points as the ink dots 102 and the treatment liquid dots 132, and they have a larger size than the treatment liquid dots 132.

In order to make the treatment liquid dots 132 larger in size than the ink dots 102, instead of making the droplet ejection volume of the treatment liquid greater than the droplet ejection volume of the ink, it is also possible to adjust the content of surfactant which is included in the treatment liquid in such a manner that the treatment liquid spreads and wets to a greater extent than the ink. Moreover, it is also possible to combine adjustment of the droplet ejection volume and adjustment of the surfactant content. Furthermore, it is also possible to employ a similar method to the method used to make the permeation suppression agent dots 142 larger in size than the treatment liquid dots 132.

The surface area of the treatment liquid dots 132 with respect to the surface area of the ink dots 102 is desirably 1.2 times or greater to 3.0 times or lower, and more desirably, 1.5 times or greater to 2.0 times or lower. Furthermore, the surface area of the permeation suppression agent dots 142 with respect to the surface area of the treatment liquid dots 132 is desirably 1.2 times or greater to 4 times or lower, and more desirably, 1.5 times or greater to 2.0 times or lower.

According to the mode shown in FIGS. 10A to 10C, it is possible to use the arrangement of ink dots for the dot arrangement of the permeation suppression agent (the dot arrangement of the treatment liquid), and this contributes to reducing the calculation load on the control system.

Figure 11A:
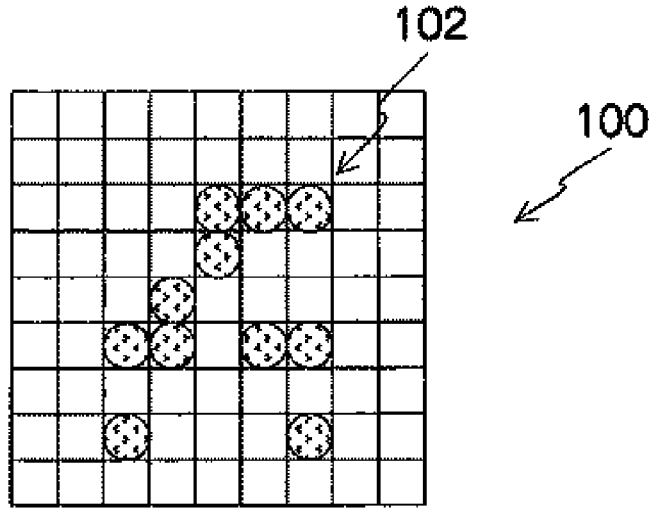
FIGS. 11A to 11C are conceptual diagrams showing yet a further mode of the dot arrangement shown in FIGS. 9A to 9C.
Figure 11B:
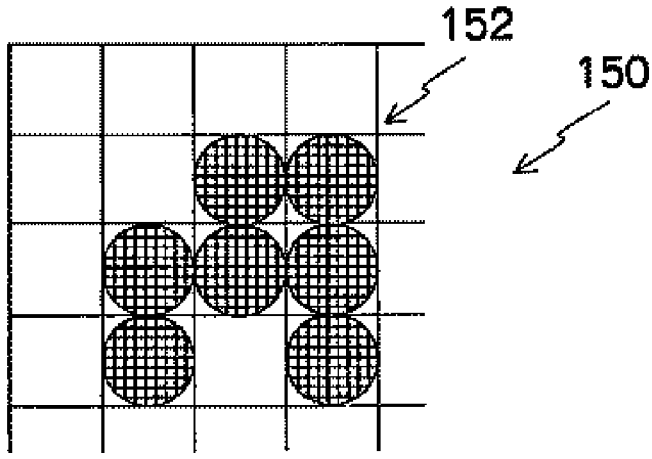
Figure 11C:
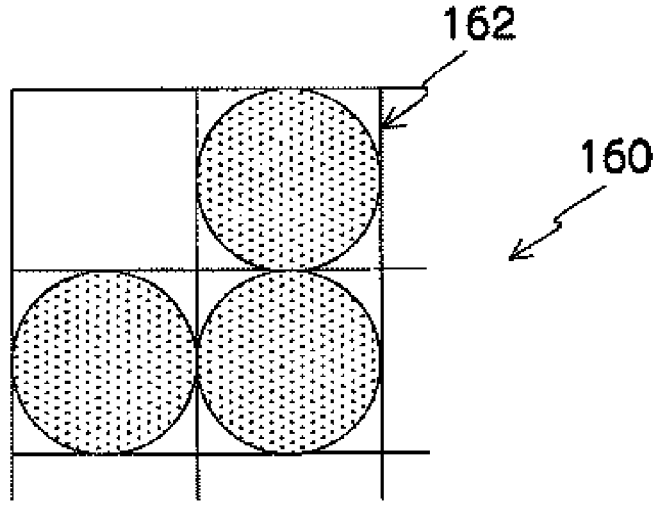

FIGS. 11A to 11C show a mode where the droplet ejection density becomes greater in the order: permeation suppression agent, treatment liquid and ink. The dot arrangement 100 shown in FIG. 11A represents the dot arrangement of the ink dots 102, which is the same as the dot arrangement 100 shown in FIG. 9A and FIG. 10A. The dot arrangement 150 shown in FIG. 11B is a dot arrangement of the treatment liquid dots 152, while the dot density in both the main scanning direction and the sub-scanning direction is ½ with respect to the dot arrangement 100 of the ink dots 102 shown in FIG. 11A, and if there is even one ink dot 102 within the range of a treatment liquid dot 152, then a droplet of treatment liquid is ejected to form the corresponding treatment liquid dot.

The dot arrangement 160 shown in FIG. 11C represents the dot arrangement created by the permeation suppression agent dots 162, the dot density in the main scanning direction and the sub-scanning direction is ½ with respect to the dot arrangement 150 of the treatment liquid dots 152 shown in FIG. 11B, and if a treatment liquid dot 152 is present within the range of a permeation suppression agent dot 162, then a droplet of permeation suppression agent is ejected to form the corresponding permeation suppression agent dot 162. For example, if the dot density of the ink dots 102 is 1200 dpi, then the dot density of the treatment liquid dots 152 is set to 600 dpi and the dot density of the permeation suppression agent dots 162 is set to 300 dpi.

In other words, in the mode shown in FIGS. 11A to 11C, the droplet ejection density of the treatment liquid is made coarser than the ink, and further-more, the droplet ejection density of the permeation suppression agent is made yet coarser than the treatment liquid, the treatment liquid dots 152 shown in FIG. 11B being formed about the periphery of the ink dots 102 shown in FIG. 11A, and the permeation suppression agent dots 162 shown in FIG. 11C being formed with respect to the treatment liquid dots 152.

According to the mode shown in FIGS. 11A to 11C, it is possible to reduce the nozzle density of the treatment liquid deposition unit 22 (the treatment liquid droplet ejection head) and the permeation suppression agent deposition unit 18 (the permeation suppression agent droplet ejection head) with respect to the ink droplet ejection heads 12C, 12M, 12Y and 12K (in other words, it is possible to increase the nozzle pitch P shown in FIG. 6), and therefore it is possible to reduce the manufacturing costs of the head. Moreover, since the ejection frequency of the treatment liquid deposition unit 22 (the treatment liquid droplet ejection head) and the ejection frequency of the permeation suppression agent deposition unit 18 (the permeation suppression agent droplet ejection head) can be reduced with respect to the ink droplet ejection heads 12C, 12M, 12Y and 12K, then it is possible to reduce the load on the control sections of the treatment liquid deposition unit 22 (treatment liquid droplet ejection head) and the permeation suppression agent deposition unit 18 (permeation suppression agent droplet ejection head).

Figure 12A:
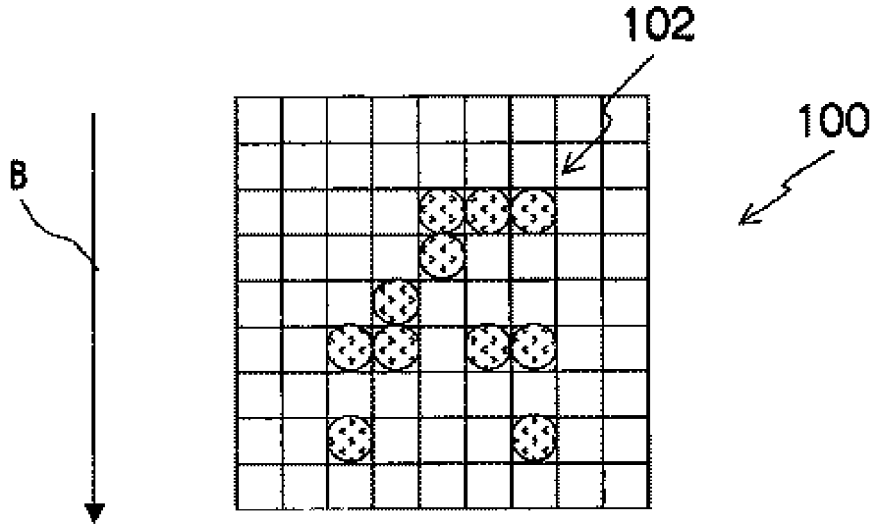
FIGS. 12A to 12C are conceptual diagrams showing yet a farther mode of the dot arrangement shown in FIGS. 9A to 11C.
Figure 12B:
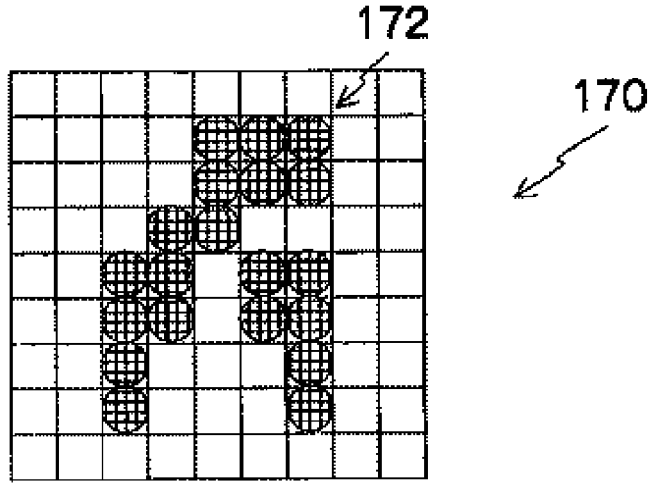
Figure 12C:
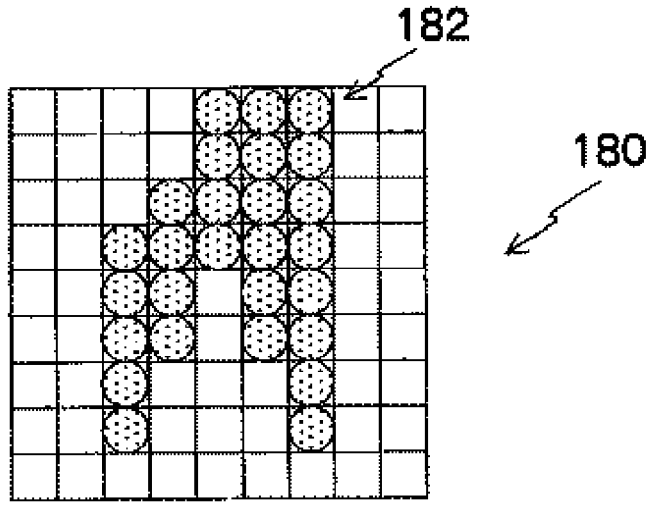

FIGS. 12A to 12C show an image pattern in which droplets of permeation suppression agent and treatment liquid are ejected for two dots prior to the ink droplet ejection unit. The dot arrangement 100 shown in FIG. 12A is a dot arrangement of the ink dots 102 shown in FIG. 9A, and the like. The arrow symbol indicated by reference symbol B in FIG. 12A indicates the droplet ejection direction (the reverse direction to the direction of conveyance of the paper 16) and ink dots 102 are formed by droplets ejected successively from the upper side toward the lower side in FIG. 12A. The droplet ejection points which are situated to the upper side of the respective droplet ejection points in FIGS. 12A to 12C are called "downstream side droplet ejection points". In other words, the downstream side droplet ejection points are ejected previously.

The dot arrangement 170 shown in FIG. 12B is a dot arrangement of the treatment liquid dots 172, and the treatment liquid dots 172 shown in FIG. 12B are formed by droplets ejected one dot position to the forward side (the prior side in the droplet ejection sequence) of the ink dots 102 shown in FIG. 12A. Furthermore, the dot arrangement 180 shown in FIG. 12C is a dot arrangement of the permeation suppression agent dots 182, and as shown in FIG. 12C, the permeation suppression agent dots 182 are formed by droplets ejected one dot position to the forward side of the treatment liquid dots 172 shown in FIG. 12B.

In other words, in the dot arrangement shown in FIGS. 12A to 12C, droplets of treatment liquid are ejected to form treatment liquid dots at the droplet ejection points of the ink dots and the droplet ejection points which are one position prior to (one position to the downstream side of) the droplet ejection points of the ink dots, and furthermore, droplets of permeation suppression agent are ejected to form permeation suppression agent dots at the droplet ejection points of the treatment liquid dots and the droplet ejection points which are one position prior to (one position to the downstream side of) the droplet ejection points of the treatment liquid dots. Since the permeation suppression agent and the treatment liquid are substantially transparent, then even if droplets of the permeation suppression agent and the treatment liquid are ejected at the droplet ejection points which are to the downstream side of the droplet ejection points of the ink dots, since they are virtually invisible, deterioration of the image due to the control of this kind hardly occurs at all.

In order to summarize the foregoing, according to the mode shown in FIGS. 12A to 12C, it is possible to prevent ejection defects of the permeation suppression agent and the treatment liquid, and in particular, ejection defects in the initial (first) ejection at the start of operation or after an interval.

Description of the Control of Application of Permeation Suppression Agent

Next, the deposition of permeation suppression agent (deposition of treatment liquid) during image recording according to embodiments of the present invention will be described in detail.

First Embodiment

Figure 13:
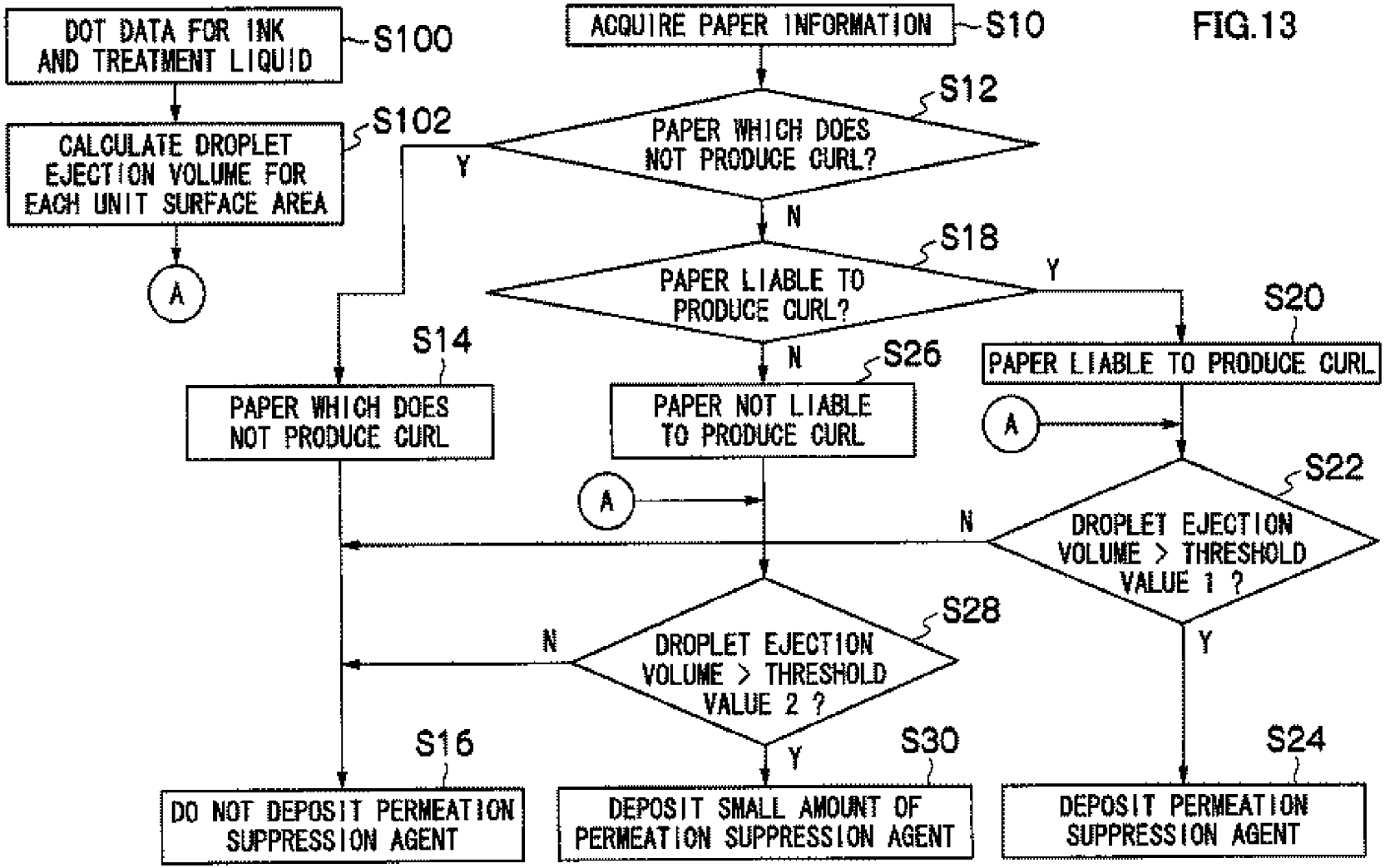
FIG. 13 is a flowchart showing the sequence of the control of the deposition of permeation suppression agent according to a first embodiment of the present invention.

FIG. 13 is a flowchart showing the control of the deposition of permeation suppression agent relating to a first embodiment.

When the permeation suppression agent deposition processing is started during image recording, firstly, information about paper used in image recording (information about the type of paper) is acquired (step S10). The paper information can be acquired automatically from an IC tag (information recording medium) which is attached to the paper supply tray, or it may be input by an operator. Furthermore it is also possible to print a test print and for the operator to actually judge the state of curl.

On the other hand, in image recording, ink dot data and treatment liquid dot data are generated on the basis of the image data (step S100), and the droplet ejection volume of ink and the droplet ejection volume of treatment liquid with respect to each unit surface area are calculated (step S102). When ejecting droplets of permeation suppression agent, at step S102, the image region (the region where ink is deposited) is divided into a plurality of regions and the droplet ejection volumes of the ink and the treatment liquid are calculated respectively for each region. The method of dividing the image region may be, for example, a method which divides the image region into regions of equal surface area.

The length of one edge of each image region is desirably 100 mm or less, or more desirably, 50 mm or less. Furthermore, if the permeation suppression agent is applied by a roller, or the like, rather than dividing the image region into a plurality of regions, the droplet ejection volumes of the treatment liquid and the ink are calculated for the whole of the image region. In other words, if the permeation suppression agent is applied with a roller or the like, then the whole of the image region is treated as the "unit surface area".

When paper information is acquired in step S10, it is judged whether or not the paper is paper which produces curl (step S12). Here, "paper which does not produce curl" may be a medium which does not include cellulose, such as an OHP sheet or a plastic base material, or a paper such as special inkjet paper in which a permeation barrier layer has been formed already on the cellulose of the paper. If it is judged in step S12 that paper does not produce curl (YES verdict), then the paper used is paper which does not produce curl (step S14) and image recording is carried out without depositing permeation suppression agent (step S16).

If it is judged in step S12 that curl occurs (NO verdict), then it is judged whether or not the paper is paper which readily produces curl (step S18). Here, "paper which does not readily produce curl" includes, for example, papers which allow slow permeation of the solvent (a medium with poor permeability) such as cardboard, paper having a large thickness like a thick paper, art paper, coated paper, and the like. Furthermore, "paper which readily produces curl" includes, for example, papers which allow fast permeation of the solvent (a permeable medium), such as a high-grade paper, thin-coated paper, and the like.

If it is judged at step S18 that the paper is liable to produce curl (YES verdict; step S20), then the droplet ejection volume determined at step S102 is compared with a previously established threshold value (threshold value 1) (step S22). If it is determined at step S22 that the droplet ejection volume is equal to or smaller than the prescribed threshold value 1 (if the droplet ejection volume is of a level which will not produce curl) (NO verdict), then the procedure advances to step S16 and image recording is carried out without depositing permeation suppression agent. On the other hand, if it is determined at step S22 that the droplet ejection volume is greater than the threshold value 1 (in the case of a droplet ejection volume which may give rise to curl) (YES verdict), then image recording is carried out by depositing a normal amount of permeation suppression agent (step S24).

Moreover, if it is judged at step S18 that the paper is not liable to produce curl (NO verdict), ten the droplet ejection volume determined at step S102 is compared with a previously established threshold value (threshold value 2) (step S28) If at step S28 the droplet ejection volume is equal to or smaller than the threshold value 2 (if the droplet ejection volume is of a level which will not produce curl) (NO verdict), then the procedure advances to step S16 and image recording is carried out without depositing permeation suppression agent. On the other hand, if at step S28 the droplet ejection volume is greater than the threshold value 2 (in the case of a droplet ejection volume which may give rise to curl) (YES verdict), then image recording is carried out in a state where a small amount of permeation suppression agent is deposited (step S30).

In other words, in the control of the application of permeation suppression agent shown in the present embodiment, the droplet ejection threshold values 1 and 2 are compared for each of the regions for which the droplet ejection volume of ink and treatment liquid has been calculated, the deposition or non-deposition of permeation suppression agent is judged for each region, and the deposition of permeation suppression agent is controlled for each region respectively.

The "normal amount" in step S24 means depositing the permeation suppression agent in accordance with a dot size and a number of dots which are determined in order to display an effect in preventing the permeation of treatment liquid in response to the droplet ejection volume of the treatment liquid, and the "deposition of a small amount of permeation suppression agent" in step S30 means reducing the liquid droplet volume or thinning out the dots with respect to the size and number of dots according to the "normal amount".

The classifications used in the present example of "paper which does not produce curl", "paper which is not liable to produce curl" and "paper which is liable to produce curl" are made for the sake of convenience, and desirably, it is determined previously on the basis of experimentation or the like, for each type of paper (medium), whether to deposit permeation suppression agent, and whether to deposit a small amount or a normal amount in cases where permeation suppression agent is to be deposited, this information being stored in the form of a database, which can be referenced to judge the deposition of permeation suppression agent required whenever paper information is acquired.

According to the control of deposition of permeation suppression agent of the first embodiment having this composition, in accordance with the type of paper used, image recording is carried out without depositing permeation suppression agent when using paper which does not curl, a smaller amount of permeation suppression agent than the normal amount is deposited when using paper which is not liable to curl, and a normal amount of permeation suppression agent is deposited when using paper which is liable to curl. Therefore, permeation suppression agent is deposited in a desirable fashion in accordance with the type of paper (recording medium).

Furthermore, since the image region is divided into a plurality of regions and the deposition of permeation suppression agent is controlled respectively for each divided region, then permeation suppression agent is deposited in a desirable fashion in accordance with contents of the image.

Second Embodiment

Next, a second embodiment of the control of the deposition of permeation suppression agent will be described. In the second embodiment described below, control is implemented in such a manner that the implementation or non-implementation of ejection of permeation suppression agent is changed in accordance with droplet ejection defects of the ink (ejection failures, and divergence in the droplet ejection positions and droplet ejection volumes).

In a single-pass type of image recording which uses a fall line type of head as shown in FIG. 2 and other drawings, if an ink droplet ejection defect occurs, then the location of this defect (the position of the image corresponding to the nozzle suffering the ejection defect) is visible as a banding non-uniformity. In the present embodiment, the method of eliminating banding of this kind involves recognizing the location where banding is occurring (the location of the ejection defect nozzle) in advance by means of a test pattern or the like, and stopping the deposition of permeation suppression agent only onto that location (the position on the image corresponding to the nozzle which has been recognized as an ejection defect nozzle) (or that location and locations peripheral to that location), in such a manner that the ink bleeds at that location and lowers the visibility of the banding non-uniformity. It is also possible to adopt a mode in which the deposition of both the permeation suppression agent and the treatment liquid are stopped.

Figure 14A:
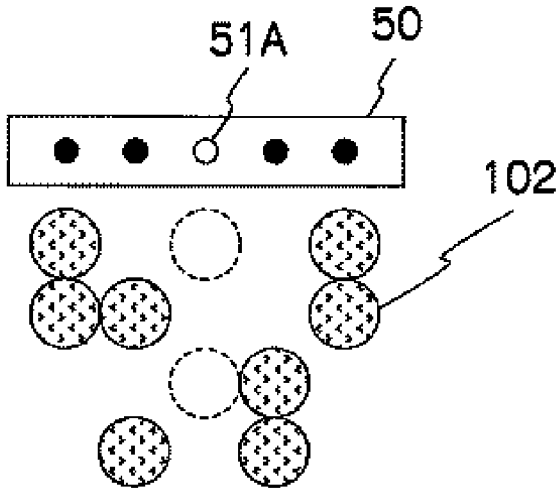
FIGS. 14A to 14C are conceptual diagrams describing the control of the deposition of permeation suppression agent according to a second embodiment of the present invention.
Figure 14B:
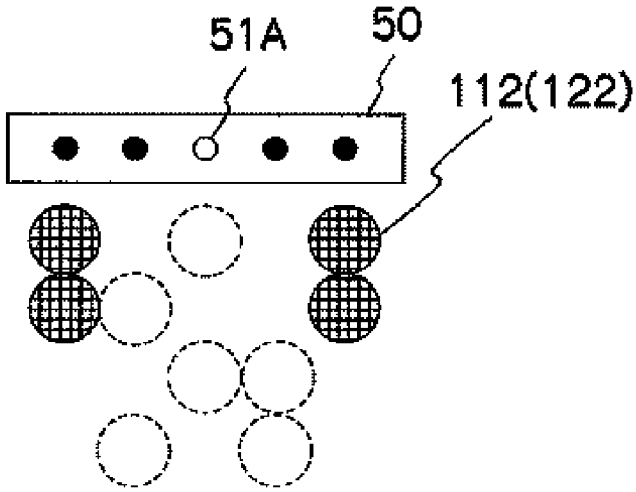
Figure 14C:
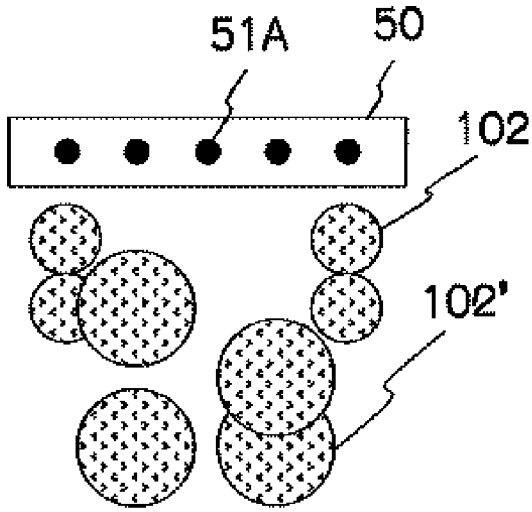

FIGS. 14A to 14C show a dot arrangement according to the second embodiment. In FIGS. 14A to 14C, if the centrally positioned nozzle 51A is suffering an ejection failure, then the droplet ejection of permeation suppression agent and treatment liquid is controlled in such a manner that permeation suppression agent and treatment liquid are not ejected onto the droplet ejection points corresponding to the central nozzle (ejection failure nozzle) 51A (the droplet ejection points of the dots indicated by the dotted lines shown in FIG. 14A) and the droplet ejection points adjacent to same on the left and right-hand sides (the droplet ejection points of dots indicated by the dotted lines in FIG. 14B).

By this means, it is possible to cause the ink dots to bleed so as to reduce the visibility of banding (FIG. 14C depicts dots which have bled and become greater than the prescribed size with the reference symbol 102').

The method described below is used in order to determine ejection abnormalities.

Firstly, a test pattern is printed, this test pattern is read in using the sensor 30 shown in FIG. 2, and the dot information of the pattern is thereby acquired. The density and central position of each of the dots are calculated on the basis of the dot information thus acquired. In the test pattern, ink droplets of the same volume are ejected from all of the nozzles so as to form dots corresponding to all of the nozzles.

If the nozzles 51 are arranged in a matrix configuration as shown in FIG. 4A, then droplets are ejected at separated positions in such a manner that the respective dots do not mutually overlap; for example, a step-shaped test pattern is formed.

The central coordinates of the dots (dot positions) and the dot densities with respect to the respective nozzles determined as described above are compared with the ideal dot central coordinates and dot densities, and the presence or absence of ejection abnormalities (ejection failure, abnormality in dot position, abnormality in dot density) are judged in respect of each of the nozzles. The method of determining ejection abnormalities can employ a method other than that described above.

According to the permeation suppression agent deposition control relating to the second embodiment which is described above, since ink ejection abnormalities are determined and nozzles which are producing ejection abnormalities are identified, and since the deposition of permeation suppression agent and the deposition of treatment liquid are controlled in such a manner that permeation suppression agent and treatment liquid are not deposited at least onto the droplet ejection points which are adjacent, in the direction perpendicular to the paper conveyance direction, to the droplet ejection point corresponding to a nozzle suffering an abnormality nozzle, then ink which has been ejected from nozzles that are adjacent to the nozzle suffering an ejection abnormality bleeds on the paper and the dots formed by this ink become greater than the prescribed size, thereby making it possible to lower the visibility of banding which is caused by a nozzle suffering an ejection abnormality.

Description of Materials

Next, the material used for the permeation suppression agent employed in the present embodiment will be described. The permeation suppression agent employed in the present embodiment contains a thermoplastic resin.

The glass transition temperature $T_g$ of the thermoplastic resin used in the permeation suppression agent of the present embodiment is desirably equal to or higher than −10° C. and equal to or lower than 100° C., and more desirably, equal to or higher than 10° C. and equal to or lower than 70° C., and even more desirably, equal to or higher than 30° C. and equal to or lower than 50° C.

If the glass transition temperature $T_g$ of the thermoplastic resin is low, then it becomes liable to form a film in the vicinity of the nozzle surface during ejection, and hence there is a problem in that the ejection stability of the permeation suppression agent declines. On the other hand, if the glass transition temperature $T_g$ of the thermoplastic resin is high, then there is also a problem in that it becomes necessary to apply a large amount of heat in order to form a film. Furthermore, the mode of the thermoplastic resin may be a mode where the resin is dispersed in a dissolved state or in the form of particles in a solvent which is described hereinafter, but it is desirable that the resin should be dispersed in the form of particles when ejecting the permeation suppression agent, since this makes it possible to lower the overall viscosity of the solution. In the case of particles, the particle size is desirably in the range of 0.01 μm or above and 5 μm or below, and more desirably, in the range of 0.05 μm or above and 1 μm or below. If the particle size is too small, then there is a problem in that a film cannot be formed on the surface since the particles permeate into the interior of the paper, and if the particle size is too large, then there is a problem in that a satisfactory film cannot be formed even if heat is applied, and the particles block up the nozzles during ejection. The weight percentage density of the thermoplastic resin is desirably in the range of 1 wt % (weight percent) or above and 40 wt % or below, more desirably, in the range of 5 wt % or above and 30 wt % or below, and even more desirably, in the range of 10 wt % or above and 20 wt % or below.

If the density of the thermoplastic resin is too low, then there is a problem in that the thermoplastic resin particles do not form a satisfactory film, which results in a partial defect, and if the density is too high, then there is a problem in that storage stability of the liquid is poor (the resin precipitates), and the viscosity is too high.

The thermoplastic resin used in the present embodiment may be any resin which satisfies the aforementioned conditions in respect of glass transition temperature $T_g$, particle size and weight percentage density, and more specifically, possible examples are: olefin polymers or copolymers, a vinyl chloride copolymer, a vinylidene chloride copolymer, a vinyl alkanate polymer or copolymer, an allyl alkanate polymer or copolymer, a polymer or copolymer of styrene or a derivative thereof, an olefin—styrene olefin—unsaturated carboxylic acid ester copolymer, an acrylonitrile copolymer, a methacrylonitrile copolymer, an alkyl vinyl ether copolymer, an acrylic acid ester polymer or copolymer, a methacrylic acid ester polymer or copolymer, a styrene—acrylic acid ester copolymer, a styrene—methacrylic acid ester copolymer, an itaconic acid diester polymer or copolymer, an anhydrous maleic acid copolymer, an acryl amide copolymer, a methacrylic amide copolymer, a hydroxy group-modified silicone resin, a polycarbonate resin, a ketone resin, a polyester resin, a silicone resin, an amide resin, a hydroxy group and carboxyl group-modified polyester resin, a butyral resin, a polyvinyl acetal resin, a cyclic rubber—methacrylic acid ester copolymer, a cyclic rubber—acrylic acid ester copolymer, a copolymer containing a heterocycle, (examples of the heterocycle being: a furan ring, a tetrahydrofuran ring, a thiophene ring, a dioxane ring, a dioxofuran ring, a lactone ring, a benzofuran ring, a benzothiofuran ring, a 1,3-dioxethane ring, or the like), a cellulose resin, a fatty acid-modified cellulose resin, an epoxy resin, and the like.

Next, an anhydrous solvent in which the thermoplastic resin described above is dissolved or dispersed will be explained. The anhydrous solvent used in the present embodiment should be one which is able to dissolve or disperse the aforementioned thermoplastic resin in a stable fashion, and which does not produce curl or produces only very slight curl even if the solvent itself permeates into the paper. More specifically, it is possible to use a straight chain or branched aliphatic hydrocarbon, an alicyclic hydrocarbon or an aromatic hydrocarbon, or a halogen substitute of these. For example, it is possible to use, independently or in combined fashion, octane, isooctane, decane, isodecane, decalin, nonane, dodecane, isododecane, cyclohexane, cyclooctane, cyclodecane, benzene, toluene, xylene, mesitylene, Isopar E, Isopar G. Isopar H, Isopar L (Isopar: tradename of Exxon Inc.), Shellzol 70, Shellzol 71 (Shellzol: tradename of Shell Oil Co.), Emsco OMS, Emsco 460 solvent (Emsco: tradename of Spirits Co., Ltd.), or the like.

In the present embodiment, an inkjet recording apparatus which records a color image onto a recording medium (paper) is described as an example, but the scope of application of the present invention is not limited to an inkjet recording apparatus, and it can also be applied widely to an image forming apparatus or liquid ejection apparatus, or the like, which forms a shape such as a certain pattern by using a liquid on a recording medium having permeable properties.

Description of Further Image Forming Method

Next, a further image forming method relating to an embodiment of the present invention will be described.

Figure 15A:
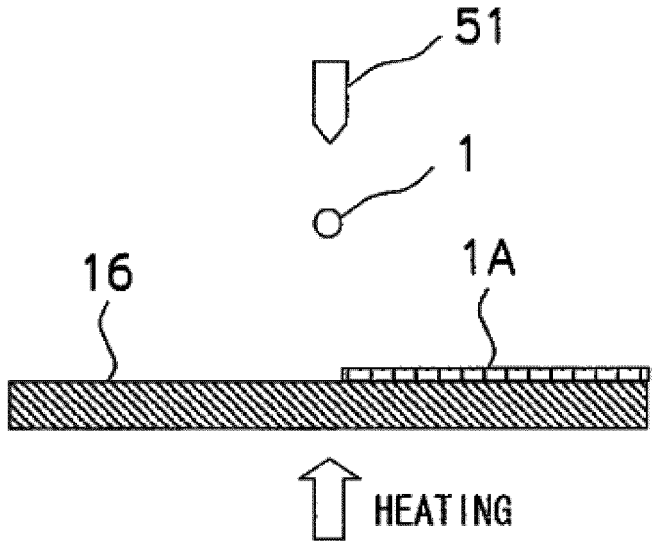
FIGS. 15A to 15C are conceptual diagrams showing a further image forming method according to an embodiment of the present invention.
Figure 15B:
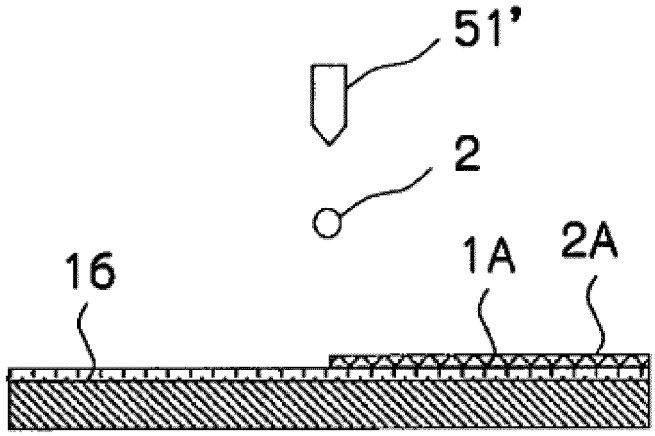
Figure 15C:
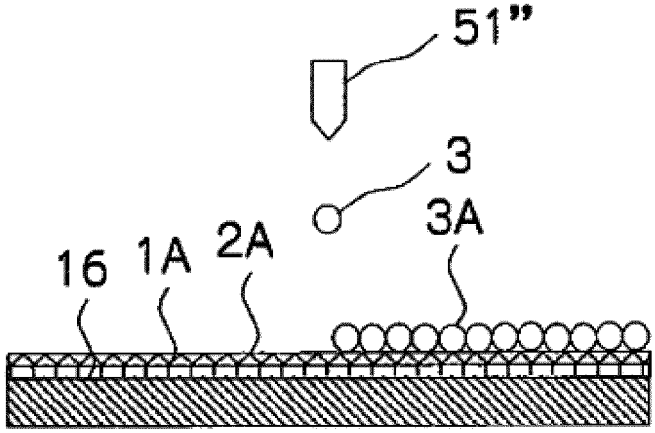

FIGS. 15A to 15C show schematic views of a further image forming method. In FIGS. 15A to 15C, parts which are the same as or similar to FIGS. 1A to 1C are labeled with the same reference numerals and further explanation thereof is omitted here.

The further image forming method shown in the present embodiment includes: a permeation suppression agent deposition step shown in FIG. 15A; a treatment liquid deposition step shown in FIG. 15B; and an ink droplet ejection step shown in FIG. 15C.

The permeation suppression agent deposition step shown in FIG. 15A deposits a permeation suppression agent that suppresses permeation of water and hydrophilic organic solvent onto a recording medium (paper) 16 (for example, a method which has permeable properties, such as inkjet paper) (the droplets of permeation suppression agent are indicated by reference numeral 1 in FIG. 1A). For the permeation suppression agent, a resin solution obtained by dispersing a resin in a solvent in the form of an emulsion, or a resin solution obtained by dissolving resin in a solvent, is used. Water or an organic solvent is suitable for use as the solvent. Desirably, the organic solvent is an organic solvent such as methyl ethyl ketone, petroleum, or the like.

The permeation suppression agent deposition step shown in FIG. 15A includes a heating process which heats the recording medium 16. In other words, by previously setting the temperature $T_1$ of the recording medium 16 to a temperature which exceeds the minimum film forming temperature $T_{f1}$ of the resin including the permeation suppression agent, by means of a heating device such as an infrared heater, then a resin film 1A is formed on the image forming surface of the recording medium 16 (an upper surface in FIGS. 15A to 15C) by the permeation suppression agent which is deposited on the recording medium 16.

The temperature $T_1$ of the recording medium 16 may be set to a temperature some 10° C. to 20° C. higher than the minimum film forming temperature $T_{f1}$ of the resin in the permeation suppression agent. In other words, the relationship between the temperature $T_1$ of the recording medium 16 in the permeation suppression agent deposition step and the minimum film forming temperature $T_{f1}$ of the resin in the permeation suppression agent desirably satisfies Expression (1) below and more desirably satisfies Expression (2) below.

$$T_1 > T_{f1} \quad \text{Expression (1)}$$

$$T_{f1} + 20(^\circ\,\text{C.}) > T_1(^\circ\,\text{C.}) > T_{f1} + 10(^\circ\,\text{C.}) \quad \text{Expression (2)}$$

Possible methods for adjusting the temperature $T_1$ of the recording medium 16 includes a method where a heating body such as a heater is provided below the conveyance base material which conveys the recording medium 16 (namely, the recording medium conveyance unit 14 in FIG. 17), a method where a heated air flow is blown from the upper surface of the recording medium 16, and a method using an infrared heater, and the like. Furthermore, it is also possible to combine these methods in an appropriate fashion.

Since the surface temperature ($T_1$) of the recording medium 16 vary depending on the type of recording medium 16 (material, thickness, etc.) and an environmental temperature, then it is desirable that the surface temperature of the recording medium 16 should be measured by providing a measuring unit (the temperature sensor 31 in FIG. 17) for measuring the surface temperature of the recording medium 16, and that a mechanism for feeding this value back to the heating unit should be provided.

In other words, if the temperature $T_1$ of the recording medium 16 in the permeation suppression agent deposition step is determined and the heating device is controlled on the basis of the determination result in such a manner that the temperature of the recording medium 16 becomes a set temperature (within a set temperature range), then even if the type of recording medium 16 changes or the ambient temperature changes, the temperature of the recording medium 16 is kept at a uniform temperature (to a uniform temperature range).

The method of depositing the permeation suppression agent may use droplet ejection based on an inkjet method (FIG. 15A shows a mode where permeation suppression agent is ejected in the form of very fine droplets from nozzles 51), or spray application, roller application, or the like. It is suitable to use an inkjet method since this makes it possible to deposit the permeation suppression agent selectively onto the positions where droplets of the ink containing coloring material are to be ejected and the periphery of same, as described below.

Furthermore, in the treatment liquid deposition step shown in FIG. 15B, a resin film (a layer created by forming a film of the resin contained in the permeation suppression agent) 1A is formed on the surface of the recording medium 16 by the permeation suppression agent deposition step, whereupon a material (treatment liquid; the treatment liquid 2 formed into very fine droplets shown in FIG. 15B) having a component which aggregates or increases the viscosity of the coloring material (pigment or dye) in the ink containing coloring material (indicated by reference numeral 3 in FIG. 15C) described above is deposited.

Possible examples of the treatment liquid include a treatment liquid which precipitates or insolubilizes the coloring material in the ink by reacting with the ink, and a treatment liquid which generates a semi-solid material (gel) that includes the coloring material in the ink, and the like. The method of generating a reaction between the ink and the treatment liquid may be a method which causes an anionic coloring material in the ink to react with a cationic compound in the treatment liquid, a method which aggregates pigment by breaking down the dispersion of the pigment in the ink due to altering the pH of the ink by mixing an ink and a treatment liquid which have different pH values, a method which aggregates pigment by breaking down the dispersion of the pigment in the ink due to a reaction with a polyvalent metal salt contained in the treatment liquid, or the like.

Similarly to the method of depositing the permeation suppression agent, the method of depositing the treatment liquid may suitably use droplet ejection based on an inkjet method (FIG. 15B shows a mode where treatment liquid is ejected in the form of very fine droplets from a nozzle 51'), spray application, roller application, or the like. It is preferable if an inkjet method is adopted, since this makes it possible to deposit the treatment liquid selectively only onto the positions where droplets of ink containing coloring material are to be ejected and the periphery thereof, as described hereinafter.

As described above, since a treatment liquid is deposited at a location where the permeation suppression agent has been deposited beforehand (onto the layer of resin film 1A), then the treatment liquid is not liable to permeate into the interior of the recording medium 16. After the coloring material component in the ink which is described below has aggregated, in order to prevent this coloring material from floating on the treatment liquid layer 2A rather than becoming attached to the recording medium 16 (resin film 1A), a desirable mode is one which includes a treatment liquid drying process for forming a treatment liquid layer 2A by drying (evaporating off) the solvent in the treatment liquid after the treatment liquid has been deposited.

In the treatment liquid drying process, the temperature $T_3$ during the process is desirably a temperature which is less than the glass transition temperature $T_{g1}$ of the resin contained in the resin film 1A. In other words, the relationship between the drying temperature $T_3$ of the treatment liquid and the glass transition temperature $T_{g1}$ of the resin contained in the permeation suppression agent satisfies the Expression (3) below.

$$T_3 < T_{g1} \qquad \text{Expression (3)}$$

Supposing that the drying temperature $T_3$ of the treatment liquid is higher than the glass transition temperature $T_{g1}$ of the resin contained in the permeation suppression agent, then fractures may occur in the resin film 1A or very fine holes, or the like, may occur in the resin film 1A when the treatment liquid is dried, and when droplets of ink are ejected, the solvent in the ink may permeate into the recording medium and consequently curl arises in the recording medium. In other words, the resin film 1A deteriorates due to the heating during the treatment liquid drying process, and the permeation suppressing function of the resin film 1A declines.

A possible example of a desirable method of drying the treatment liquid which is able to prevent deterioration of the resin film 1A described above is a method which blows heated air or dried air onto the surface of the recording medium 16.

The ink droplet ejection step shown in FIG. 15C ejects ink droplets 3 containing resin from the nozzle 51" in order to form dots which correspond to the input image by means of an inkjet method. In other words, a desired image is recorded on the recording medium 16 by ejecting ink droplets 3 in accordance with the image data onto the region where the treatment liquid layer 2A has been formed in advance.

In FIG. 15C, the ink droplets which have been deposited onto the recording medium 16 (treatment liquid layer 2A) are indicated by reference numeral 3A. When these ink droplets 3A and the treatment liquid layer 2A react together, a state is created in which the ink aggregate (dots) and the solvent are separated.

A desirable mode is one which includes, after the ink droplet ejection step, an ink drying step for drying the solvent that is left remaining on the recording medium. In the ink drying step, the solvent is evaporated off by using a heating device such as an infrared heater (it is possible to use a composition similar to the heating devices in other steps), in a state where the treatment liquid and the ink have reacted together after the ejection of ink droplets and have separated into an ink aggregate (dots) and solvent. The temperature $T_4$ in the ink drying step may be set to be higher than the glass transition temperature $T_{g1}$ of the resin contained in the permeation suppression agent (the resin film 1A).

A desirable mode is one which includes, instead of or in combination with the ink drying step, a solvent absorbing step for absorbing and removing the solvent in the ink (the solvent remaining on the recording medium 16) by bringing a liquid absorbing member such as a porous body into contact with the surface of the recording medium 16.

Furthermore, a desirable mode is one which includes a fixing step which fixes the image formed on the recording medium 16. By bringing a heated roller member into contact with the surface of the recording medium 16 (the image forming surface), the resin contained in the ink and the resin (latex, or the like) contained in the permeation suppression agent are melted and adhesive forces between the ink (dots 3A) and the permeation suppression agent (resin film 1A) and between the permeation suppression agent and the recording medium 16 are obtained.

The relationship between the glass transition temperature $T_{g1}$ of the resin contained in the permeation suppression agent and the glass transition temperature $T_{g2}$ of the resin contained in the ink desirably satisfies Expression (4) below.

$$T_{g1}<T_{g2} \qquad \text{Expression (4)}$$

In other words, since the surface structure of the recording medium 16 is formed in sequence from the lower portion by the recording medium 16, the resin film 1A and the ink (coloring material and resin), then when recording medium on which images have been recorded are stacked together after image recording has been completed, the ink which is the uppermost surface of the recording medium 16 makes contact with the rear surface of the recording medium stacked thereabove. In cases such as these, if the relationship between the glass transition temperature $T_{g1}$ of the resin contained in the permeation suppression agent and the glass transition temperature $T_{g2}$ of the resin contained in the ink satisfies $T_{g1}>T_{g2}$, then the resin in the ink becomes attached to the rear surface of the recording medium stacked thereabove.

Moreover, from the viewpoint of the adhesiveness of the recording medium 16, making the glass transition temperature $T_{g1}$ of the resin contained in the permeation suppression agent and the glass transition temperature $T_{g2}$ of the resin contained in the ink satisfy the relationship stated in Expression (4) above, a higher adhesiveness is obtained.

Moreover, the glass transition temperature $T_{g1}$ of the resin contained in the aggregating treatment liquid and the temperature $T_2$ of the recording medium 16 during the ink fixing process satisfy Expression (5) below, and the glass transition temperature $T_{g2}$ of the resin contained in the ink and the temperature $T_2$ of the recording medium 16 during the ink fixing process satisfy the Expression (6) below.

$$T_2>T_{g1} \qquad \text{Expression (5)}$$

$$T_2>T_{g2} \qquad \text{Expression (6)}$$

By making the glass transition temperature $T_{g1}$ of the resin contained in the aggregating treatment liquid, the glass transition temperature $T_{g2}$ of the resin contained in the ink and the temperature $T_2$ of the recording medium 16 during the ink fixing process satisfy Expressions (5) and (6) given above, then it is possible to melt the resin contained in the ink and the resin contained in the aggregating treatment liquid satisfactorily during the fixing process Description of Evaluation Experiment There follows a description of experiments which were carried out by the present inventor in order to evaluate the prevention of curl, and the fixing properties and recording properties (bleeding, dot floating) in the above-described image forming method illustrated in FIGS. 15A to 15C.

Recording Medium

In the present evaluation experiment, product "Urite" (made by Nippon Paper Group, weight 84.9 g/m$^2$) was used as the recording medium 16 shown in FIGS. 15A to 15C.

Permeation Suppression Agent

In the present evaluation experiment, the permeation suppression agent A and the permeation suppression agent B were used as the permeation suppression agent.

Permeation Suppression Agent A

The permeation suppression agent A was manufactured by using the procedure described below.

A mixed solution containing 10 g of a dispersion stabilizer (Q-1) having the structure shown in "Chemical Formula 1" below, 100 g of vinyl acetate and 384 g and Isopar H (tradename of Exxon Mobil Corporation) was heated to a temperature of 70° C. while being agitated in a nitrogen gas flow.

Chemical Formula 1

[Q-1]

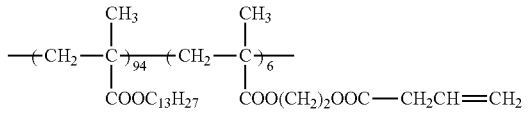

$\overline{M}w\ 4\times10^4$ $\overline{M}w\ 4\times10^4$: Composition ratio by weight 0.8 g of 2,2-azobis (isovaleronitrile; abbreviation: A.I.V.N.) was added as a polymerization initiator, and the mixture was reacted for 3 hours. 20 minutes after adding the polymerization initiator, white turbidity was produced and the reaction temperature rose to 88° C.

A further 0.5 g of polymerization initiator was added and after reacting for 2 hours, the temperature was raised to 100° C., the mixture was agitated for 2 hours, and the vinyl acetate which had not reacted was removed. After cooling, the liquid was passed through a 200 mesh nylon cloth, and the white dispersed material obtained thereby was a latex having a polymerization rate of 90%, an average particle size of 0.23 μm, and good monodispersity. The particle size of the latex was measured using a CAPA-500 particle size analyzer (made by Horiba, Ltd.)

A portion of the white dispersed material (latex) described above was placed in a centrifuge apparatus (rotational speed: 1×104 r.p.m., operating time: 60 minutes), and the settled resin particles were collected and dried and the weight-average molecular weight (Mw), glass transition temperature ($T_g$) and minimum film forming temperature (MFT) of the resin particles were measured. The results were: Mw=2×105 (polyethylene-converted GPC value), $T_g$=38° C. and MFT=28° C.

Permeation Suppression Agent B

The permeation suppression agent B was manufactured by using the procedure described below.

A mixed solution containing 15 g of a dispersion stabilizer (Q-2) having the structure shown in (Chemical Formula 2) below, 75 g of benzine methacrylate, 25 g of methyl acrylate, 1.3 g of 3-methyl mercaptopropionate and 552 g of Isopar H (tradename of Exxon Mobil Corporation) was heated to a temperature of 50° C. while being agitated in a nitrogen gas flow.

Chemical Formula 2

[Q-2]

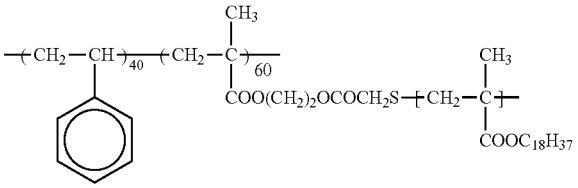

$\overline{M}w\ 5 \times 10^4$ $\overline{M}w\ 5\times10^4$: Composition ratio by weight 1.0 g of 2,2-azobis(2-cyclopropyl propionitrile; abbreviation: A.C.P.P.) was added as a polymerization initiator, and the mixture was reacted for 2 hours. After adding a further 0.8 g of A.C.P.P.1. and reacting for 2 hours, 0.8 g of a polymerization initiator A.I.V.N. was added, the reaction temperature was set to 75° C. and reaction was continued for 3 hours.

Thereupon, the temperature was raised to 90° C., and the unreacted monomer substance was removed under a reduced pressure atmosphere of 20 to 30 mmHg, whereupon the mixture was cooled and passed through a 200 mesh nylon cloth. The white dispersed material thus obtained was a latex having a polymerization rate of 98%, an average particle size of 0.20 μm and good monodispersity. The particle size of the latex was measured using a CAPA-500 particle size analyzer (made by Horiba, Ltd.)

The weight-average molecular weight (Mw) of the resin particles was 2×104 (polyethylene-converted GPC value), the glass transition temperature ($T_g$) was 55° C. and the minimum film forming temperature (MFT) was 43° C.

Pigment

The pigment used in the present evaluation experiment was manufactured as described below.

A dispersion liquid was manufactured by combining and agitating 10 g of Cromophtal Jet Magenta DMQ (PR-122) made by Ciba Specialty Chemicals Holding Inc., 10.0 g of dispersion polymer, 4.0 g of glycerine, and 26 g of deionized (ion-exchanged) water Thereupon, ultrasonic waves were irradiated for two hours in an intermittent fashion (irradiation 0.5 second/halt 1.0 second) in order to further disperse the pigment, using an ultrasound irradiation apparatus (Vibra-cell VC-750 manufactured by SONICS & MATERIALS, INC., taper micro chip: φ5 mm, Amplitude: 30%), and thereby a 20 wt % pigment dispersion liquid was obtained.

Ink

Ink A, ink B and ink C which have the compositions described below were used in the present evaluation experiment.

Ink A

| | |
|---|---|
| Pigment (magenta): | 4 wt % |
| Glycerine (made by Wako Pure Chemical Industries, Ltd.): | 20 wt % |
| Diethylene glycol (made by Wako Pure Chemical Industries, Ltd.): | 10 wt % |
| Olefin E1010 (made by Nissin Chemical Industry Co., Ltd.): | 1 wt % |
| Deionized water: | remainder |

Ink B

| | |
|---|---|
| Pigment (magenta): | 4 wt % |
| Joncryl 790 (made by Johnson Polymers (BASF Japan Ltd.)): | 8 wt % |
| Glycerine (made by Wako Pure Chemical Industries, Ltd.): | 20 wt % |
| Diethylene glycol (made by Wako Pure Chemical Industries, Ltd.): | 10 wt % |
| Olefin E1010 (made by Nissin Chemical Industry Co., Ltd.): | 1 wt % |
| Deionized water: | remainder |

The glass transition temperature ($T_g$) of the Joncryl 790 as measured by the DSC method was 90° C.

Ink C

| | |
|---|---|
| Pigment (magenta): | 4 wt % |
| Joncryl 537 (made by Johnson Polymers (BASF Japan Ltd.)): | 8 wt % |
| Glycerine (made by Wako Pure Chemical Industries, Ltd.): | 20 wt % |
| Diethylene glycol (made by Wako Pure Chemical Industries, Ltd.): | 10 wt % |
| Olefin E1010 (made by Nissin Chemical Industry Co., Ltd.): | 1 wt % |
| Deionized water: | remainder |

The glass transition temperature ($T_g$) of the Joncryl 537 as measured by the DSC method was 40° C.

Treatment Liquid

The treatment liquid having the following composition (indicated as treatment liquid 2 in FIG. 15B) was used in the present evaluation experiment.

| | |
|---|---|
| Citric acid (made by Wako Pure Chemical Industries, Ltd.): | 15 wt % |
| Olefin E1010 (made by Nissin Chemical Industry Co., Ltd.): | 1 wt % |
| Deionized water: | remainder |

Experimental Method

Forming Resin Film

Firstly, the permeation suppression agent described above was applied to the recording medium using a No. 2 coating rod. In applying the permeation suppression agent, the recording medium was placed on a hot plate and the temperature of the hot plate was adjusted to achieve a prescribed temperature (35° C., 40° C. and 60° C.). When no heating was applied, the temperature was 20° C.

After applying permeation suppression agent to the recording medium, heated air was blown for 3 seconds onto the recording medium which had been coated with permeation suppression agent, thereby evaporating off the Isopar H.

Formation of Treatment Liquid Layer

Droplets of treatment liquid were ejected in a solid pattern onto the recording medium which had been cut to A5 size. The recording medium having droplets of treatment liquid ejected onto the whole surface thereof was subjected to a drying treatment at a prescribed temperature (35° C., 50° C.).

Ink Droplet Ejection

Droplets of ink A were ejected in a solid pattern onto a recording medium on which a layer of treatment liquid had been formed. Similarly, droplets of ink B were ejected in a solid pattern onto the recording medium on which a layer of treatment liquid had been formed, and furthermore, droplets of ink C were also ejected in a solid pattern onto the recording medium 16 on which a layer of treatment liquid had been formed. The dot density of the ink droplet ejection was 1200 dpi×1200 dpi, and the ink droplet ejection volume (the volume of one ink droplet) was 4 pl.

Ink Drying Process, Fixing Process

When the ink droplet ejection had ended, a temperature of 70° C. was applied for three seconds, thereby drying the ink. Furthermore, a fixing process was carried out at 80° C.

Evaluation Results

After passing through the steps (processes) described above and recording a solid image onto the recording medium, the curl and fixing properties of the recording medium 16 were evaluated. Furthermore, the image recording properties (bleeding and floating of coloring material) were evaluated while altering the image contents.

FIG. 16 shows the experimental conditions and evaluation results of the present evaluation experiment. In FIG. 16, No. 1 indicates a case where image recording was carried out without depositing permeation suppression agent and treatment liquid, and No. 2 indicates a case where image recording was carried out without depositing permeation suppression agent but with depositing treatment liquid.

Curl

The floating heights of the four corners of the recording medium 16 were measured and the arithmetic average of these four values (the total floating heights of the four points divided by 4) is set as the curl indicator value. The sign of "Excellent" verdict is assigned if the curl indicator value was less than 0.5 cm, the sign of "Good" verdict is assigned if it was equal to or greater than 0.5 cm and less than 1.0 cm, the sign of "Not Poor" verdict is assigned if it was equal to or greater than 1.0 cm and less than 2.0 cm, and the sign of "Poor" verdict was assigned if it is equal to or greater than 2.0 cm. If the paper curled in such a manner that the region of the center of the recording medium 16 rose upward, then the recording medium 16 was turned over so that the four corners were rising upwards (facing to the upper side) and measurement was then carried out.

As shown in FIG. 16, if in addition to depositing permeation suppression agent, the recording medium was heated during the deposition of permeation suppression agent ($T_1$: 35° C. to 60° C.), then the curl indicator value became less than 2.0 cm (evaluation verdict "Excellent", "Good", or "Not Poor") and hence a beneficial effect in suppressing the curl of the recording medium could be obtained. In other words, in cases where permeation suppression agent was not deposited (Nos. 1 and 2), or in cases where permeation suppression agent was deposited but the recording medium was not heated and the permeation suppression agent did not form a film (Nos. 3, 5, 8, 11, 15, 20), a large amount of curl which was of an unacceptable level occurred (evaluation "Poor"), and an effect in suppressing curl could not be obtained.

Furthermore, if the temperature $T_1$ of the recording medium during deposition of the permeation suppression agent was set to a temperature exceeding the minimum film forming temperature $T_{f1}$ of the resin in the permeation suppression agent ($T_1>T_{f1}$), then the curl indicator value became less than 1.0 cm (evaluation verdict "Excellent" or "Good"), and hence a greater effect in suppressing curl could be obtained.

In cases where the drying temperature $T_3$ of the treatment liquid was set to a temperature lower than the glass transition temperature $T_{g1}$ of the resin in the permeation suppression agent ($T_3<T_{g1}$), the curl indicator value was less than 0.5 cm (evaluation verdict "Excellent"), and hence a good effect in suppressing curl could be obtained.

In other words, as shown in FIG. 16, if the permeation suppression agent contains a resin having a glass transition temperature $T_g$ of 38° C., then by setting the drying temperature $T_3$ of the treatment liquid (the temperature of the recording medium during the treatment liquid drying process) to be less than 38° C. (in the present evaluation experiment, 35° C.), breaking, such as the occurrence of fractures, in the resin film (see FIGS. 15A to 15C) during the treatment liquid drying process can be prevented. Consequently, ink is prevented from entering in via the breakage points in the resin film and permeating into the recording medium, and hence an even higher effect in suppressing curl can be obtained.

Fixing Properties

The image forming surface of the recording medium used in the curl evaluation described above (the surface on which a solid image had been formed) was rubbed ten times (back and forth) with a recording medium which had not been printed on, and the respective contact surfaces of the rubbed printed recording medium (the recording medium receiving the rubbing action) and the rubbing non-printed recording medium (the recording medium performing the rubbing action) were observed visually.

An "Excellent" verdict was assigned in cases where there was no adherence of coloring material to the rubbing recording medium and no deterioration of the image on the rubbed recording medium; a "Good" verdict was assigned in cases where there was adherence of coloring material to the rubbing recording medium but there was no deterioration of the image on the rubbed recording medium; a "Not Poor" verdict was assigned in cases where there was slight adherence of the image (coloring material) of the rubbed recording medium, to the rubbing recording medium; and a "Poor" verdict was assigned in cases where the rubbing recording medium had a darker density of coloring material than the rubbed recording medium.

As shown in FIG. 16, in cases where image recording was carried out by ejecting droplets of treatment liquid and ink after depositing permeation suppression agent, and furthermore, the fixing temperature (the temperature of the recording medium during the fixing process) $T_2$ was set to a temperature exceeding the glass transition temperature $T_{g1}$ of the resin in the permeation suppression agent ($T_2>T_{g1}$), then good fixing properties were obtained (evaluation verdict "Excellent", "Good", "Not Poor").

Moreover, in cases where the fixing temperature $T_2$ was a temperature exceeding the glass transition temperature $T_{g2}$ of the resin in the ink (in FIG. 16, ink B: $T_{g2}$=90° C., ink C: $T_{g2}$=40° C.) (in other words, if $T_2>T_{g2}$), then good fixing properties were obtained (evaluation verdict "Excellent").

In other words, by setting the fixing temperature $T_2$ to a temperature exceeding the glass transition temperature $T_{g1}$ of the resin in the permeation suppression agent ($T_2>T_1$), the adhesiveness between the resin layer created by the resin in the permeation suppression agent and the coloring material (the resin contained in the ink) is improved and good image fixing properties onto the recording medium can be achieved. Moreover, by setting the fixing temperature $T_2$ to a temperature which exceeds the glass transition temperature $T_{g2}$ of the resin in the ink ($T_2>T_{g2}$), the aggregating properties inside the coloring material (the internal strength of the coloring material) is improved and higher fixing properties of the image onto the recording medium can be obtained.

Bleeding

In evaluating bleeding, lines of 1200 dpi were printed in a single pass, and the state of these lines was checked out by visual observation (enlarged using a microscope).

An "Excellent" verdict was assigned in cases where no irregularities in line width, line breaks or liquid pooling were observed; a "Good" verdict was assigned in cases where no liquid pooling was observed in the lines but the ends of the lines were blurred (width irregularities were observed in the end portions of the lines); and a "Poor" verdict was assigned in cases where line width irregularities, line breaks or liquid pooling were observed.

As shown in FIG. 16, if permeation suppression agent was deposited, then it was possible to obtain good lines having no bleeding ("Excellent" evaluation verdict). On the other hand, in cases where permeation suppression agent was not deposited, then if treatment liquid was not deposited either (case No. 1), the evaluation verdict was "Poor", and if treatment liquid was deposited (case No. 2), the evaluation verdict was "Good".

In other words, if permeation suppression agent is not deposited, then bleeding occurs as a result of the ink permeating into the recording medium. Furthermore, even if permeation suppression agent is not deposited but treatment liquid is deposited, although the permeation of the ink into the recording medium is suppressed to some degree by the action of the treatment liquid, bleeding occurs due to the treatment liquid permeating into the recording medium.

Floating of Coloring Material

In evaluating the floating of the coloring material (movement of the coloring material), a lattice pattern having a spacing of 150 dpi was printed in a single pass, and an "Excellent" verdict was assigned to cases where the divergence in the dot spacing was less than 3% (5.1 μm), while a "Poor" verdict was assigned to cases where the divergence in the dot spacing was 3% (5.1 μm) or greater.

As shown in FIG. 16, if treatment liquid is deposited and furthermore the treatment liquid is also dried (cases No. 6 to No. 23), then movement of the coloring material is suppressed. On the other hand, if treatment liquid is not deposited (No. 1) or if treatment liquid is deposited but it is not dried (No. 2 to No. 5), then movement of the coloring material occurs.

Summary (1) By depositing permeation suppression agent containing a resin onto the recording medium and heating the recording medium (permeation suppression agent) to form a resin film, it is possible to suppress curl of the recording medium.

(2) By making the relationship between the temperature of the recording medium during the deposition of permeation suppression agent (the temperature when forming a film of the resin in the permeation suppression agent) $T_1$ and the minimum film forming temperature of the resin $T_{f1}$ satisfy $T_1>T_{f1}$, then a good resin film is formed and a high curl suppressing effect can be obtained.

(3) By making the relationship between the treatment liquid drying temperature $T_3$ and the glass transition temperature $T_{g1}$ of the resin in the permeation suppression agent satisfy $T_3>T_{g1}$, breaking of the resin film is prevented and a high curl suppressing effect can be obtained (4) By making the relationship between the fixing temperature $T_2$ and the glass transition temperature $T_{g1}$ of the resin in the permeation suppression agent satisfy $T_2>T_{g1}$, the adhesiveness between the resin film and the coloring material (the resin in the ink) is improved, and desirable fixing properties of the image onto the recording medium can be obtained.

(5) By making the relationship between the fixing temperature $T_2$ and the glass transition temperature $T_{g2}$ of the resin in the ink satisfy $T_2>T_{g2}$, the internal aggregation properties (strength) of the coloring material are improved, and desirable fixing properties of the image onto the recording medium can be obtained.

(6) If treatment liquid is deposited and the treatment liquid is also heated and dried (to form a treatment liquid layer), then bleeding and movement of the coloring material is prevented.

The permeation suppression agent used in the present evaluation experiment employs Isopar H (an isoparaffin type of solvent) as the solvent, and therefore the permeation suppression agent can be deposited (ejected in the form of droplets) by an inkjet method. Consequently, it is possible to form a resin film by means of the resin in the permeation suppression agent, in a selective fashion on the recording medium, and for example, if a resin film is formed only on the region where the image is to be formed (image region: the region where ink is to be deposited), then change in the appearance (namely, change in the luster, change in the color tone) of non-image portions where an image is not formed by the resin layer (regions where ink is not deposited) is prevented.

Further Apparatus Composition

Figure 17:
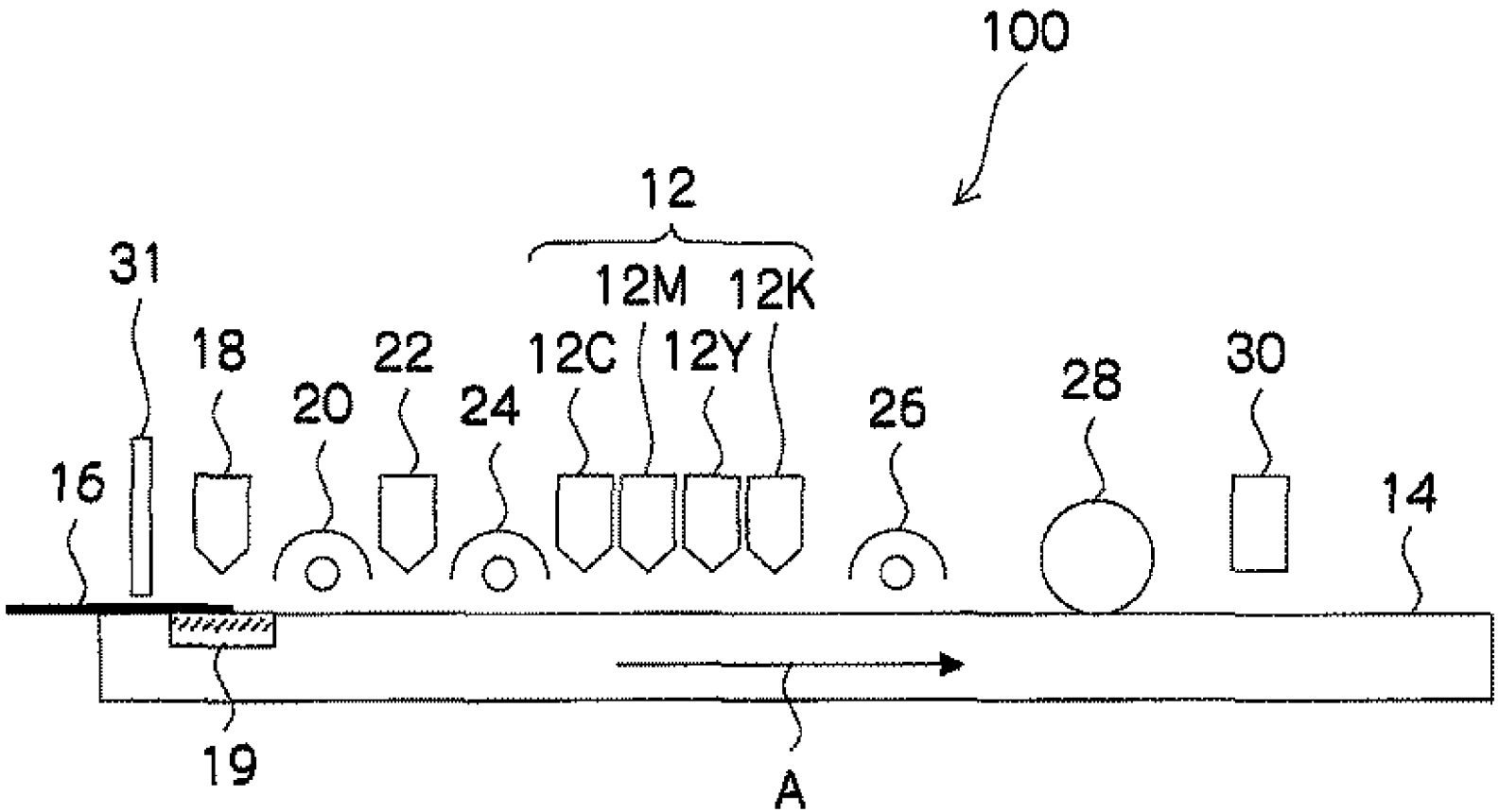
FIG. 17 is a general schematic drawing of an inkjet recording apparatus relating to a further embodiment of the present invention.

Next, an image forming apparatus (inkjet recording apparatus) which employs the further image forming method shown in FIGS. 15A to 15C will be described. FIG. 17 is a general schematic drawing of an inkjet recording apparatus 100 in which the further image forming method is employed. In FIG. 17, parts which are the same as or similar to those in FIG. 3 are labeled with the same reference numerals and further explanation thereof is omitted here.

The inkjet recording apparatus 100 shown in FIG. 17 comprises a heater 19 which heats the recording medium 16 during deposition of the permeation suppression agent, in addition to the composition of the inkjet recording apparatus 10 shown in FIG. 2. In the present embodiment, the heater 19 is incorporated directly below the permeation suppression agent deposition unit 18 of the recording medium conveyance unit 14, and a heating process is applied to the record-mg medium 16 immediately before the deposition of permeation suppression agent, during the deposition of permeation suppression agent and immediately after the deposition of permeation suppression agent, in such a manner that a resin film (permeation suppression film) is formed on the image forming surface of the recording medium 16 by the resin in the permeation suppression agent.

Furthermore, a temperature sensor 31 which determines the temperature of the recording medium 16 (the temperature of the image forming surface of the recording medium 16) is provided in the heating region of the heater 19, and the heater 19 is controlled on the basis of the determination results from the temperature sensor 31 in such a manner that the temperature of the recording medium 16 comes within a prescribed range. It is desirable to use a non-contact type of temperature sensor for the temperature sensor 31.

It is desirable to use an infrared heater for the heater 19. The positioning of the heater 19 is not limited to the position shown in FIG. 17, and provided that a resin film is formed by the resin in the permeation suppression agent provided to the recording medium 16 by the time that the droplets of treatment liquid are ejected, it may also be disposed to the upstream side of the permeation suppression agent deposition unit 18 in terms of the direction of conveyance of the recording medium, or it may be disposed to the downstream side of the permeation suppression agent deposition unit 18 in terms of the direction of conveyance of the recording medium. Furthermore, it may also be disposed over a broad range from the upstream side to the downstream side in terms of the direction of conveyance of the recording medium.

In the present embodiment, a mode is described above in which a heater 19 is incorporated into the recording medium conveyance unit 14, but it is also possible to dispose the heater 19 in such a manner that it opposes the image forming surface of the recording medium 16. Furthermore, instead of the heater 19, it is also possible to heat the recording medium 16 by means of a method which blows dry air or heated air onto the recording medium 16, or to combine the use of heating by a heater 19 and heated air flow.

The rest of the composition of the inkjet recording apparatus 100 shown in FIG. 17 is the same as that in FIG. 2, and description thereof is omitted here. Furthermore, the print unit described with reference to FIGS. 4A to 4C to FIG. 8, the structure of the head and the composition of the supply system are also the same, and further description thereof is omitted here.

Figure 18:
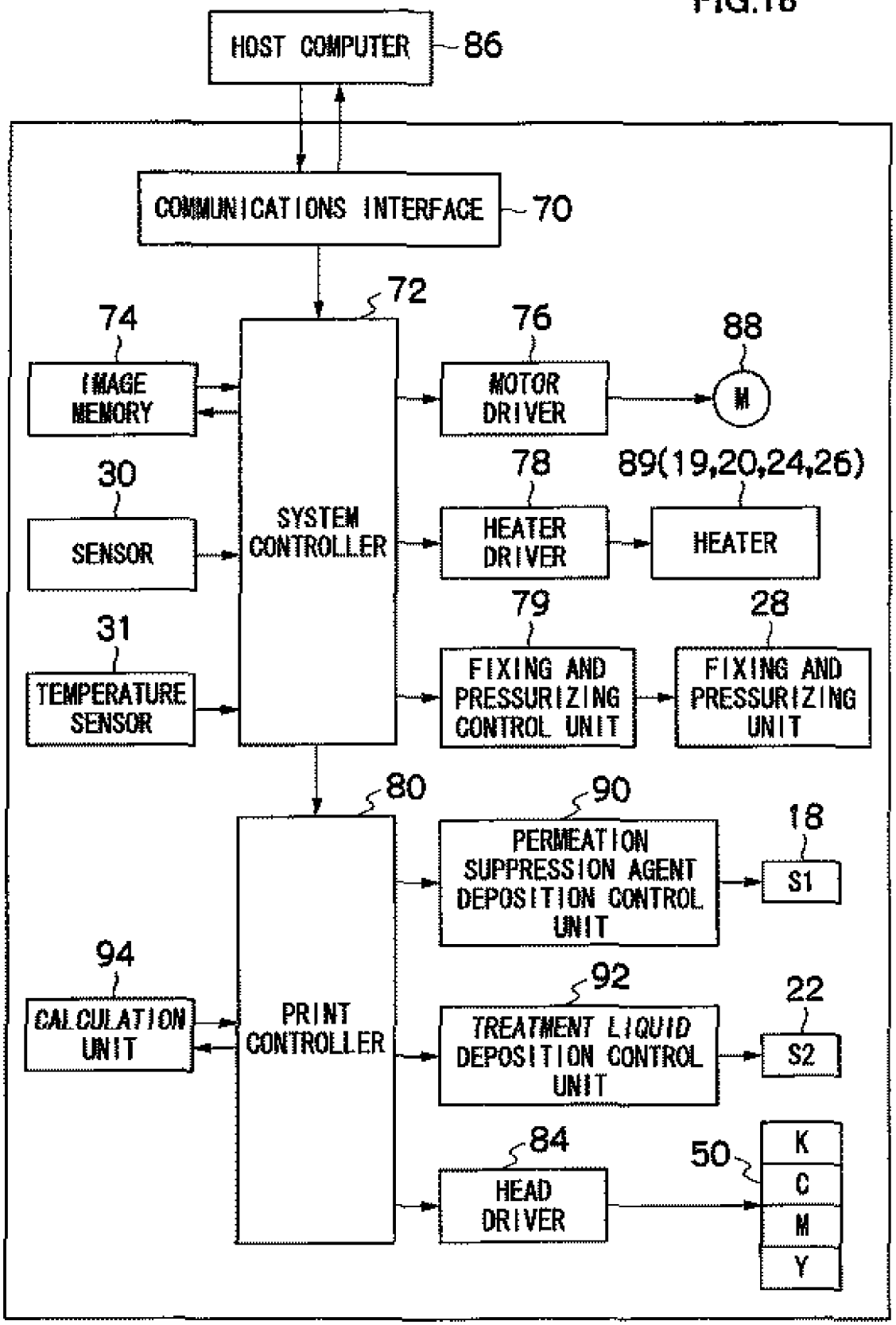
FIG. 18 is a principal block diagram showing the system configuration of the inkjet recording apparatus shown in FIG. 17.

FIG. 18 is a principal block diagram showing the system configuration of the inkjet recording apparatus 100 shown in FIG. 17. In FIG. 18, parts which are the same as or similar to FIG. 8 are labeled with the same reference numerals and further explanation thereof is omitted here.

The system composition of the inkjet recording apparatus 100 shown in FIG. 18 comprises the temperature sensor 31 in addition to the system composition of the inkjet recording apparatus 10 shown in FIG. 2 (see FIG. 8). More specifically, when the system controller 72 shown in FIG. 18 acquires temperature information for the recording medium 16 supplied from the temperature sensor 31, and this temperature information (determination temperature) is compared with a set temperature (set temperature range); if the determination temperature is lower than the set temperature, then the amount of heat radiated by the heater 19 is raised, and if the determination temperature is higher than the set temperature, then a command signal is sent to the heater driver 78 in such a manner that the amount of heat radiated by the heater 19 is lowered. Upon receiving this command signal, the heater driver 78 executes control of the heat radiation by the heater 19 in accordance with the command signal.

The beater 89 shown in FIG. 18 includes the heater 19 which heats the recording medium 16 during the deposition of permeation suppression agent in FIGS. 15A to 15C, the heater of the permeation suppression agent drying unit 20, the heater of the treatment liquid drying unit 24, the heater of the ink drying unit 26, and the like.

Moreover, the inkjet recording apparatus 100 shown in FIG. 18 can employ the method of depositing permeation suppression agent and treatment liquid shown in FIGS. 9A to 9C to FIG. 13.

According to the image forming method and apparatus having the composition described above, by depositing the permeation suppression agent (a resin solvent containing resin) onto the recording medium 16 and also carrying out heat treatment, a resin film is formed on the surface of the recording medium 16, and therefore the permeation of the treatment liquid and the ink into the recording medium 16 is suppressed by the resin film and curl does not occur in the recording medium 16.

In the present embodiment, an inkjet recording apparatus which records a color image on a recording medium is described as an example, but the scope of application of the present invention is not limited to an inkjet recording apparatus and it may also be applied widely to an image forming apparatus which forms a prescribed shape (pattern) by using a liquid on a medium having permeable properties, or a liquid application apparatus which applies liquid to a medium in accordance with a prescribed pattern, or the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus which records an image onto a recording medium by using an ink containing a coloring material, the inkjet recording apparatus comprising:

a first treatment agent deposition device including a first treatment agent droplet ejection head which ejects droplets of a first treatment agent through nozzles and deposits the droplets of the first treatment agent onto the recording medium, the first treatment agent having a function of suppressing permeation of liquid into the recording medium;

a second treatment agent deposition device which deposits a second treatment agent having at least one of a function of aggregating the coloring material contained in the ink and a function of increasing viscosity of the ink, onto the recording medium;

a drying device which dries the second treatment agent having been deposited on the recording medium;

an image processing device which converts input image data into dot data; and an ink droplet ejection head which ejects and deposits droplets of the ink onto the recording medium in accordance with the dot data, wherein the first treatment agent contains a non-aqueous liquid which does not produce curl of the recording medium even if permeating into the recording medium, and at least one of a first resin of which particles are dispersed in the non-aqueous liquid and a second resin which is dissolved in the non-aqueous liquid, a glass transition temperature of each of the first resin and the second resin being not lower than 10° C. and not higher than 70° C.

2. The inkjet recording apparatus as defined in claim 1, wherein:

the second treatment agent deposition device includes a second treatment agent droplet ejection head which ejects and deposits droplets of the second treatment agent onto the recording medium; and the inkjet recording apparatus further comprises a first treatment agent droplet ejection control device and a second treatment agent droplet ejection control device which control respectively the first treatment agent droplet ejection head and the second treatment agent droplet ejection head in such a manner that:

the droplets of the first treatment agent are deposited onto a first deposition region of the recording medium, the first deposition region including a second deposition region of the recording medium onto which the droplets of the second treatment agent are deposited and a third deposition region of the recording medium surrounding the second deposition region, and a surface area of first dots formed from the droplets of the first treatment agent on the recording medium is not smaller than 1.5 times and not larger than 2 times with respect to a surface area of second dots formed from the droplets of the second treatment agent on the recording medium; and the droplets of the second treatment agent are deposited onto an ink droplet deposition region of the recording medium onto which the droplets of the ink are deposited and a region surrounding the ink droplet deposition region, and the surface area of the second dots is not smaller than 1.5 times and not larger than 2 times with respect to a surface area of ink dots formed from the droplets of the ink on the recording medium.

3. The inkjet recording apparatus as defined in claim 1, wherein:

the second treatment agent deposition device includes a second treatment agent droplet ejection head which ejects and deposits droplets of the second treatment agent onto the recording medium; and the inkjet recording apparatus further comprises a first treatment agent droplet ejection control device and a second treatment agent droplet ejection control device which control respectively the first treatment agent droplet ejection head and the second treatment agent droplet ejection head in such a manner that the droplets of the first treatment agent are deposited onto first droplet deposition points of the recording medium, the first droplet deposition points including second droplet deposition points of the recording medium onto which the droplets of the second treatment agent are deposited and third droplet deposition points of the recording medium which are adjacent to the second droplet deposition points.

4. The inkjet recording apparatus as defined in claim 1, wherein:

the second treatment agent deposition device includes a second treatment agent droplet ejection head which ejects and deposits droplets of the second treatment agent onto the recording medium; and the inkjet recording apparatus further comprises a first treatment agent droplet ejection control device and a second treatment agent droplet ejection control device which control respectively the first treatment agent droplet ejection head and the second treatment agent droplet ejection head in such a manner that:

the droplets of the first treatment agent are deposited onto droplet deposition points of the recording medium;

the droplets of the second treatment agent are deposited onto the same droplet deposition points; and dots formed from the droplets of the first treatment agent are larger in size than dots formed from the droplets of the second treatment agent respectively on the droplet deposition points.

5. The inkjet recording apparatus as defined in claim 1, wherein:

the second treatment agent deposition device includes a second treatment agent droplet ejection head which ejects and deposits droplets of the second treatment agent onto the recording medium;

the inkjet recording apparatus further comprises a first treatment agent droplet ejection control device and a second treatment agent droplet ejection control device which control the first treatment agent droplet ejection head and the second treatment agent droplet ejection head in accordance with first dot data and second dot data, respectively; and the image processing device generates the first dot data for the first treatment agent and the second dot data for the second treatment agent from the input image data in such a manner that a droplet deposition density of the first treatment agent is smaller than a droplet deposition density of the second treatment agent.

6. The inkjet recording apparatus as defined in claim 1, further comprising:

a conveyance device which conveys the recording medium in a conveyance direction; and a first treatment agent droplet ejection control device which controls the first treatment agent droplet ejection head in such a manner that the droplets of the first treatment agent are deposited onto first droplet deposition points of the recording medium, the first droplet deposition points including ink droplet deposition points of the recording medium onto which the droplets of the ink are deposited and downstream droplet deposition points of the recording medium which are adjacent respectively to a downstream side of the ink droplet deposition points in terms of the conveyance direction.

7. The inkjet recording apparatus as defined in claim 1, wherein the first treatment agent includes wax.

8. The inkjet recording apparatus as defined in claim 1, wherein the glass transition temperature of the first resin is not lower than 30° C. and not higher than 50° C.

9. The inkjet recording apparatus as defined in claim 1, wherein:

a particle size of the particles of the first resin is not smaller than 0.01 μm and not larger than 5 μm; and a concentration of the first resin in the first treatment agent is not lower than 1 wt % and not higher than 40 wt %.

10. The inkjet recording apparatus as defined in claim 1, wherein:

a particle size of the particles of the first resin is not smaller than 0.05 μm and not larger than 1 μm; and a concentration of the first resin in the first treatment agent is not lower than 1 wt % and not higher than 40 wt %.

11. The inkjet recording apparatus as defined in claim 1, wherein:

a particle size of the particles of the first resin is not smaller than 0.01 μm and not larger than 5 μm; and a concentration of the first resin in the first treatment agent is not lower than 5 wt % and not higher than 30 wt %.

12. The inkjet recording apparatus as defined in claim 1, wherein:

a particle size of the particles of the first resin is not smaller than 0.05 μm and not larger than 1 μm; and a concentration of the first resin in the first treatment agent is not lower than 5 wt % and not higher than 30 wt %.

13. The inkjet recording apparatus as defined in claim 2, further comprising a recording medium judgment device which judges a type of the recording medium, wherein the first treatment agent droplet ejection control device controls the first treatment agent droplet ejection head in such a manner that, when the type of the recording medium judged by the recording medium judgment device is not liable to produce curl, an amount of the first treatment agent deposited onto the recording medium is reduced in comparison with a case where the type of the recording medium judged by the recording medium judgment device is liable to produce curl.

14. The inkjet recording apparatus as defined in claim 2, further comprising:

a second treatment agent deposition volume calculation device which calculates a deposition volume of the second treatment agent; and an ink deposition volume calculation device which calculates a deposition volume of the ink, wherein the first treatment agent droplet ejection control device controls the first treatment agent droplet ejection head in such a manner that the first treatment agent is deposited in a case where a sum total of the deposition volume of the second treatment agent and the deposition volume of the ink is equal to or greater than a threshold value, and the first treatment agent is not deposited in a case where the sum total of the deposition device of the second treatment agent and the deposition volume of the ink is less than the threshold value.

15. The inkjet recording apparatus as defined in claim 14, wherein the second treatment agent deposition volume calculation device calculates the deposition volume of the second treatment agent from the dot data for the second treatment agent into which the image processing device converts the input image data.

16. The inkjet recording apparatus as defined in claim 14, wherein:

the second treatment agent volume calculation device calculates the deposition volume of the second treatment agent with respect to each of divisional regions of the recording medium that the recording medium is divided into;

the ink deposition volume calculation device calculates the deposition volume of the ink with respect to each of the divisional regions of the recording medium; and the first treatment agent droplet ejection control device controls the first treatment agent droplet ejection head in such a manner that deposition of the first treatment agent is adjusted with respect to each of the divisional regions.

17. The inkjet recording apparatus as defined in claim 14, wherein the threshold value is set according to the recording medium.

18. The inkjet recording apparatus as defined in claim 2, further comprising an abnormality determination device which determines droplet ejection abnormalities in the ink droplet ejection head, wherein the first treatment agent droplet ejection control device controls the first treatment agent droplet ejection head so as not to deposit the first treatment agent onto positions on the recording medium which correspond to locations of the droplet ejection abnormalities determined by the abnormality determination device.

19. The inkjet recording apparatus as defined in claim 18, wherein the first treatment agent droplet ejection control device controls the first treatment agent droplet ejection head so as not to deposit the first treatment agent onto the positions on the recording medium which correspond to the locations of the droplet ejection abnormalities determined by the abnormality determination device and positions adjacent to the positions on the recording medium which correspond to the locations of the droplet ejection abnormalities.

* * * * *